US010319355B2

(12) United States Patent
Abadi

(10) Patent No.: US 10,319,355 B2
(45) Date of Patent: Jun. 11, 2019

(54) DOUBLE-ENDED KEYBOARD DEVICE

(71) Applicant: Nomi Ines Abadi, Laguna Niguel, CA (US)

(72) Inventor: Nomi Ines Abadi, Laguna Niguel, CA (US)

(73) Assignee: Nomi Ines ABADI, Glendale, CA (US)

( * ) Notice: Subject to any disclaimer, the term of this patent is extended or adjusted under 35 U.S.C. 154(b) by 0 days.

(21) Appl. No.: 16/116,767

(22) Filed: Aug. 29, 2018

(65) Prior Publication Data

US 2019/0066645 A1 Feb. 28, 2019

Related U.S. Application Data

(60) Provisional application No. 62/551,503, filed on Aug. 29, 2017.

(51) Int. Cl.

| | |
|---|---|
| ***G10H 1/32*** | (2006.01) |
| ***G10H 1/34*** | (2006.01) |
| ***G10H 1/00*** | (2006.01) |

(52) U.S. Cl.

CPC ..... *G10H 1/344* (2013.01); *G10H 1/0008* (2013.01); *G10H 2220/096* (2013.01); *G10H 2220/221* (2013.01); *G10H 2230/365* (2013.01)

(58) Field of Classification Search

CPC ..... G10H 1/344; G10H 1/0008; G10H 2220/221; G10H 2230/365; G10H 2220/096

USPC ..... 84/743, 744

See application file for complete search history.

(56) References Cited

U.S. PATENT DOCUMENTS

| | | | | | |
|---|---|---|---|---|---|
| 5,463,925 | A * | 11/1995 | Galocy | G10C 3/12 | 400/682 |
| 5,841,052 | A * | 11/1998 | Stanton | G10H 1/32 | 84/600 |
| 6,259,006 | B1 * | 7/2001 | Parienti | G10H 1/32 | 84/171 |
| 7,667,119 | B1 * | 2/2010 | Schlapkohl | G10C 3/12 | 84/376 R |
| 7,928,312 | B2 * | 4/2011 | Sharma | G10H 1/34 | 84/423 R |
| 2004/0083877 | A1 * | 5/2004 | Bubar | G10H 1/344 | 84/423 R |
| 2006/0117939 | A1 * | 6/2006 | Lai | G10H 1/34 | 84/744 |

* cited by examiner

*Primary Examiner* — Jeffrey Donels
(74) *Attorney, Agent, or Firm* — Gordon & Rees LLP

(57) ABSTRACT

The present disclosure relates to double-ended keyboard devices and methods. In one embodiment, a device includes a first housing having a first keyboard section and control surface, with input keys arranged in a first direction and a second housing having a second keyboard section and control surface, with input keys arranged in a second direction. The device includes a joint securing the first housing and the second housing to provide rotation of the housings along an axis. The device also includes a control unit configured to detect input to housing and to generate output. The device includes an output interface coupled to the control unit. Processes are described including generating output based on detected input to the first and second keyboard sections and controlling output. Operations and devices configurations allow for a wearable control device that may be operated or played like an instrument.

20 Claims, 22 Drawing Sheets

DOUBLE-ENDED KEYBOARD DEVICE

CROSS-REFERENCE TO RELATED APPLICATIONS

This application claims priority to U.S. Provisional Application No. 62/551,503 filed on Aug. 29, 2017 and titled DOUBLE-ENDED KEYBOARD DEVICE, the content of which is expressly incorporated by reference in its entirety.

FIELD

The present disclosure relates to music devices, and more particularly to keyboard instruments and control devices, and methods for operating same.

BACKGROUND

Musical instruments come in various configurations. By way of example, electronic keyboards come in a variety of styles. Typical electronic keyboards use a series of keys or inputs arranged in side-by side fashion often similar to keys on a piano. Pianos and electronic keyboards are typically not configured to be worn due to weight and other considerations. In addition, these devices typically require that a performer play the keyboard with keys in a horizontal position wherein that the performer generally presses down on keys from a seated position. Musicians and live performers desire an instrument that can be played while standing and that allows for movement of the performer while playing the instrument.

A keytar is an electronic keyboard device that may be worn, similar to the way a guitar is supported by a strap, and that allows a performer to use the device while standing. A keytar and other similar devices include a single keyboard and an elongated neck with one or more sound controls on the elongated neck. The Keytar typically includes a single unibody design, where the keys and input devices are located in fixed positions. Drawbacks of the keytar include a limited number of keys that can be included—left hand use limited entirely to pitch bending or effect inputs with limited to no tonal key control. Keytars additionally have an unflattering design with a body shape that can be cumbersome. Because the keytar is typically played with one hand to activate keys, the number of tones and styles that can be generated or controlled by the user may be limited. Most users find two-handed use of a single keyboard on a keytar impossible or impractical to operate as the keytar lends itself entirely to right hand playing. The neck controls on a keytar are not keys, but sound effects, and are limited as the keytar neck is too skinny to afford keys for left hand operation. The configurations and features of the keytar lend the device to provide mostly a novelty value, such as for playing single notes and single hand playing, which does not embody a desired range of a keyboard device.

There exists a desire for improved devices and instruments.

BRIEF SUMMARY OF THE EMBODIMENTS

Disclosed and claimed herein are device configurations and processes for operating keyboard instruments and keyboard control devices. One embodiment is directed to a double-ended keyboard device including a first housing including a first keyboard section and a first housing control surface, wherein keys of the first keyboard section are arranged in a first direction. The double-ended keyboard device including a second housing including a second keyboard section and a second housing control surface, wherein keys of the second keyboard are arranged in a second direction, the second direction different from the first direction. The double-ended keyboard device also including a joint securing the first housing and the second housing, wherein the joint operates to provide rotation of the first housing relative to the second housing along an axis associated with first housing and second housing. The double-ended keyboard device including a control unit configured to detect input to each of the first housing and the second housing, the control unit configured to generate output in response to the input, and an output interface coupled to the control unit, the output interface configured to provide output for the double-ended keyboard device in response to input to at least one of the first keyboard section and the second keyboard section.

In one embodiment, the first keyboard section and second keyboard section each include a piano keyboard key arrangement having a plurality of keys, wherein each key is associated with a tone.

In one embodiment, the first keyboard section and second keyboard section together provide a sequential set of tone inputs for the double-ended keyboard device.

In one embodiment, the first keyboard section and second keyboard section each include a plurality of elongated hinge keys, wherein each key is detected as an independent control input.

In one embodiment, the first keyboard section is associated with right hand operation, the second keyboard section is associated with left hand operation, and wherein the double-ended keyboard device is configured to be worn by a user.

In one embodiment, the first housing control surface and the second housing control surface are arranged along a shared axis.

In one embodiment, the joint includes a shaft received by each of the first housing and the second housing, and a cam configured to secure a rotational arrangement of the first housing relative to the second housing.

In one embodiment, the joint receives a communication interface from a keyboard section to the controller.

In one embodiment, the joint provides rotation and fixed locking position of housing relative to a body line.

In one embodiment, the first housing and second housing include planar top surfaces for the control interface.

In one embodiment, the control unit is configured to generate sound output for detected input to each of the first keyboard section and second keyboard section.

In one embodiment, the control unit is configured to generate control output for detected input to each of the first keyboard section and second keyboard section.

In one embodiment, the output interface includes at least one of a single ended input, stereo output, control interface terminal and terminals for at least one external device.

In one embodiment, the control unit is configured to generate output for the first keyboard section independent from the second keyboard section and generate output for the second keyboard section independent from the first keyboard section.

In one embodiment, the double-ended keyboard device includes a touch screen interface on the first housing control surface, wherein output for the double-ended keyboard device is based on one or more sound banks, tone control and pitch settings of the touch screen interface, and wherein at least one instrumental mode is provided for the double-ended keyboard device for user in at least one configuration including as a synthesizer to an omnichord mode.

Another embodiment is directed to process for operating a double-ended keyboard device. In one embodiment, the process includes detecting input to a first keyboard section, detecting input to the second keyboard section and generating output based on detected input to the first keyboard section and second keyboard section. The process also includes controlling output for the double-ended keyboard device to an output interface coupled to the control unit in response to detected input to at least one of the first keyboard section and the second keyboard section.

In one embodiment, detecting input to the first keyboard section and second keyboard section includes detecting input piano keyboard key arrangements having a plurality of keys, wherein each key is associated with a tone.

In one embodiment, detecting input to the first keyboard section and second keyboard section includes detecting input to a plurality of elongated hinge keys, wherein each key is detected as an independent control input.

In one embodiment, controlling output for the double-ended keyboard device includes aggregating detected inputs and control settings for providing output to the output interface.

Another embodiment is directed to a double-ended keyboard device including a first housing including a first keyboard section and a first housing control surface, wherein keys of the first keyboard section are arranged in a first direction, and a second housing including a second keyboard section and a second housing control surface, wherein keys of the second keyboard are arranged in a second direction, the second direction different from the first direction. The first keyboard section and second keyboard section each include a piano keyboard key arrangement having a plurality of keys, wherein each key is associated with a tone. The double-ended keyboard device includes a joint securing the first housing and the second housing, wherein the joint operates to provide rotation of the first housing relative to the second housing along an axis associated with first housing and second housing. The double-ended keyboard device includes a control unit configured to detect input to each of the first housing and the second housing, the control unit configured to generate output in response to the input. The double-ended keyboard device includes an output interface coupled to the control unit, the output interface configured to provide output for the double-ended keyboard device in response to input to at least one of the first keyboard section and the second keyboard section.

Other aspects, features, and techniques will be apparent to one skilled in the relevant art in view of the following detailed description of the embodiments.

BRIEF DESCRIPTION OF THE DRAWINGS

The features, objects, and advantages of the present disclosure will become more apparent from the detailed description set forth below when taken in conjunction with the drawings in which like reference characters identify correspondingly throughout and wherein.

DETAILED DESCRIPTION OF THE EXEMPLARY EMBODIMENTS

Overview and Terminology

Figure 1:
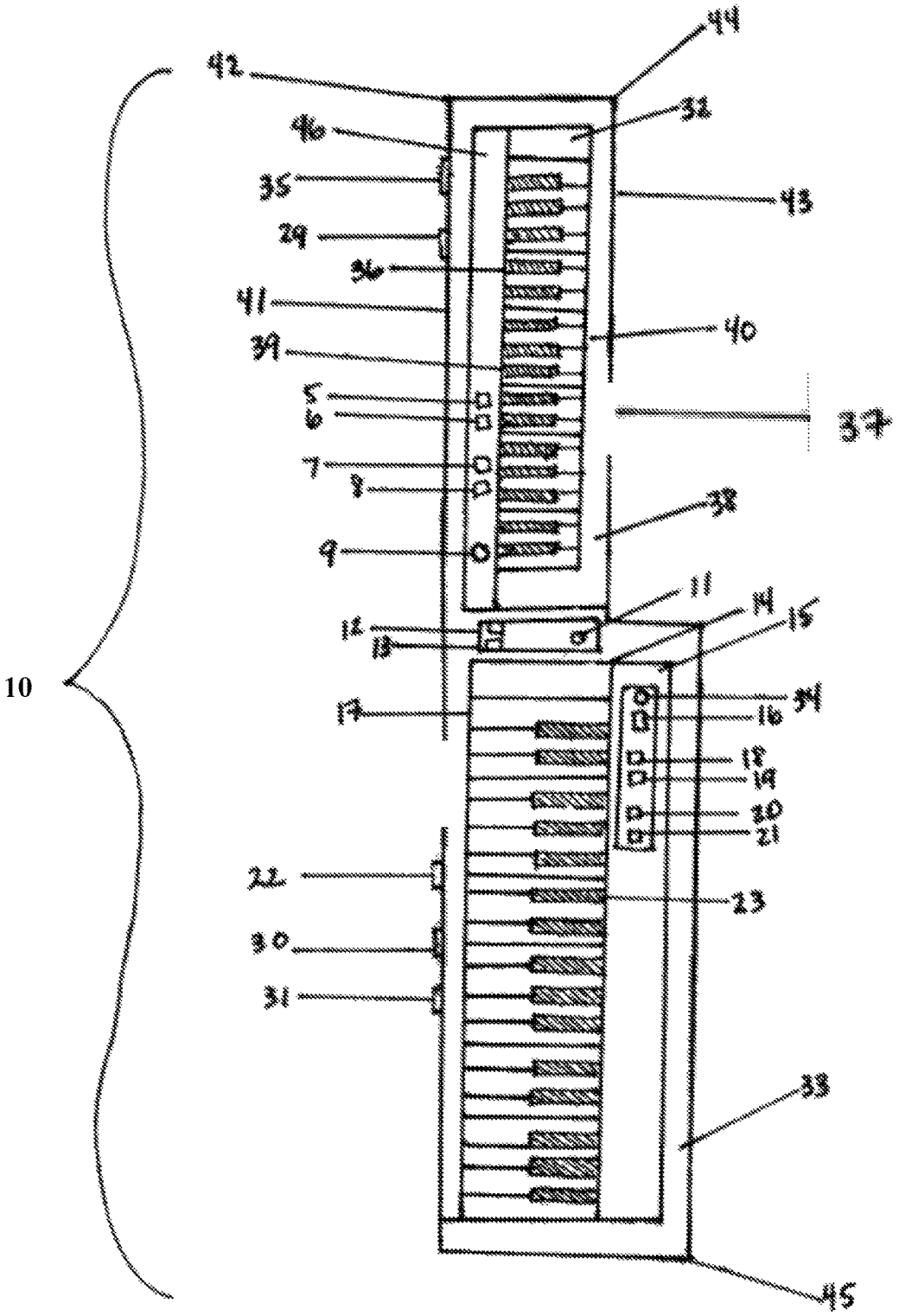
FIG. 1 depicts a graphical representation of a double-ended keyboard device according to one or more embodiments.

One aspect of the disclosure is directed to keyboard instruments and control devices, and methods for operating same. In one embodiment, a double-ended keyboard device is provided to include two keyboards (e.g., keyboard sections). The two keyboards may be jointly supported and retained by a housing or body. According to one embodiment, the two keyboards are arranged to include two separate sets of keys, which may be similar to piano keys. The two separate sets of keys allow for a double-ended configuration. According to another embodiment, the two keyboards of the device include a first keyboard arranged on a first section of the housing with the keys pointing a first direction, and the second keyboard is arranged on a second non-overlapping section of the housing with a plurality of keys facing a second direction. The second direction may be different from the first direction, such as opposite the first direction, to allow for the keyboards to be oriented relative to a user's hands. Embodiments discussed herein may be with reference to a right hand play configuration. By way of example, similar to a right hand configuration for a guitar, the user's right hand is generally positioned lower than the user's left hand during use. For the keyboard arrangement, a right hand configuration includes the user's right hand for keys facing the user, and the user's left hand in a supinated position to play keys facing away from the user (see FIGS. 4A-4B). However, it should be appreciated that other embodiments may be configured in a left hand configuration such that a first keyboard section (e.g., a larger keyboard section) is arranged for the user's left hand, wherein the second keyboard section includes keys facing away from the user and configured for the user's right hand in a supinated arrangement.

In one embodiment, a double-ended keyboard device is provided to include two keyboards (e.g., keyboard sections) having a first housing and a second housing. The first housing can include a first keyboard section and a first control surface. The second housing can include a second keyboard section and a second control surface. According to one embodiment, the first and second housing may be coupled and secured to each other by a joint. According to one or more embodiments the joint is configured to allow fixing the first and second housing in a secure position. According to another embodiment, the joint may be configured to provide rotation of a first housing relative to a second housing.

Electronic devices and keyboards described herein may relate to control devices which output one or more signals to control another device. Alternatively, or in combination, electronic devices and keyboards described herein may include one or more sound generation modules (e.g., synthesizers) and outputs (e.g., output terminals, speakers, etc.) to generate sound signals. Electronic device configurations described herein can detect operation of the plurality of keyboards and one or more device settings and outputs sounds based on the keyboard operation and device settings. For example, when a key is hit, a signal may be generated associated with a tone assigned to that key (e.g., pitch and stylization) for the duration that the key is pressed. Multiple keys can be pressed at one time. Similarly, controller configurations described herein can detect keyboard operation and output signals in response to the keyboard operation. Output signals can be control signals.

As used herein, a keyboard includes a plurality of input keys, each input of a keyboard group associated with a particular portion of a housing. A keyboard can include one or more types of keys (e.g., piano keys, etc.). The keyboard may include a layout or configuration having a piano key layout including having white keys and black keys, wherein each keyboard ground may include one or more octaves of tones. In one embodiment, the two keyboards may provide a 72-key configuration, wherein two 36-key keyboards are provided. The two 36-key keyboards may each be located on one end of the housing to form a double-ended configuration. The two keyboards together may provide a range of 9 octaves. In other embodiments, the two keyboards may have other key configurations to allow for additional and/or fewer keys relative to each keyboard. In certain embodiments, a keyboard device includes a first keyboard and a second keyboard section, wherein the first keyboard section (e.g., right hand section for a right hand arranged device, left hand section for a left hand variation of the keyboard device) has a greater number of keys than the second keyboard section.

Music instrument and control device configurations can include analog keys wherein the magnitude of a control output or the volume of a tone may correspond with how much force a key receives when pressed. One or more sound banks may be employed for assigned tone or sound to each keyboard. In certain embodiments, keyboards of the device may output different sounds based on different sound banks. The keyboards may also be configured to output sound along a continuous range, such that the lowest key of one keyboard follows the next tone after the highest key of the other keyboard. Alternatively, the tones of one keyboard may not follow the tones of the other key board. As such, a user may set the starting tone of each keyboard independently.

According to one embodiment, device configurations may allow for each keyboard to control one or more devices. In one embodiment, a first keyboard controls a first device, and a second keyboard controls a second device. Outputs of the device may include one or more output types and interfaces including, but not limited to quarter-inch stereo outputs and inputs, control interfaces (e.g., MIDI, etc.) including input and output and other control interfaces and terminals.

Another aspect of the disclosure is directed to providing a configuration for housing and retaining a plurality of keyboards. In one embodiment, a single housing configuration is provided. According to other embodiments, a multiple element housing body configuration may be provided with the separate parts configured to be connected. In either of the single and multiple housing configurations, the housing elements or sections may be rotated to allow for positioning of keyboards.

One embodiment is directed to a double-ended keyboard musical instrument. The instrument includes a first keyboard section and a second supporting section. Each section may include a first end, a second end, side edges, a planar front surface and a horizontal rear surface. The first keyboard section includes a keyboard on the horizontal front surface extending along a first side edge, a holding portion and the second end. The second keyboard supporting section may have a reduced size second end such that the reduced size may be used by the left hand for supporting the double-ended keyboard section in a horizontal position. The first and second keyboard sections may be rearranged to allow for left hand and right hand play configurations. The left hand configuration of a keyboard device may be configured to include the same features of the right hand configuration, wherein the larger housing is associated with a user's left hand.

As used herein, the terms "a" or "an" shall mean one or more than one. The term "plurality" shall mean two or more than two. The term "another" is defined as a second or more. The terms "including" and/or "having" are open ended (e.g., comprising). The term "or" as used herein is to be interpreted as inclusive or meaning any one or any combination. Therefore, "A, B or C" means "any of the following: A; B; C; A and B; A and C; B and C; A, B and C". An exception to this definition will occur only when a combination of elements, functions, steps or acts are in some way inherently mutually exclusive.

Reference throughout this document to "one embodiment," "certain embodiments," "an embodiment," or similar term means that a particular feature, structure, or characteristic described in connection with the embodiment is included in at least one embodiment. Thus, the appearances of such phrases in various places throughout this specification are not necessarily all referring to the same embodiment. Furthermore, the particular features, structures, or characteristics may be combined in any suitable manner on one or more embodiments without limitation.

Exemplary Embodiments

Referring now to the figures, FIG. 1 depicts a graphical representation of keyboard device according to one or more embodiments. According to one embodiment, device 10 is a double-ended keyboard musical instrument. In certain embodiments, device 10 may be a control device, such as device outputting control signals according to a control format, such as the MIDI format. In other embodiments, device 10 may include one or more synthesizers for producing sound output.

According to one embodiment, device 10 may include at least two keyboard sections including a plurality of keys. Device 10 has a body 38 including a first keyboard section 33 and second keyboard section 37. In one embodiment, body 38 is a one-piece body. According to another embodiment, body 38 may include a multi-body structure for keyboard sections for device 10. According to one embodiment, first keyboard section 33 may be larger than second keyboard section 37. As shown in FIG. 1, second keyboard section 37 is stacked vertically upon first keyboard section 33. Device 10 may include one or more key configurations, such as at least one of 61, 72 and 88 key variations.

According to one embodiment, first keyboard section 33 and second keyboard section 37 each have a first end, a second end, side edges, a planar front surface and a horizontal rear surface. The first keyboard section 33 may have second keyboard section 37 on the horizontal front surface extending along a first side edge, a holding portion and the second end, and the second keyboard section 37 may have a reduced size second end whereby the reduced size may be used by the left hand for supporting the double-ended keyboard section in a horizontal position.

In one embodiment, the double-ended keyboard musical instrument offers 72 keys across a 48-inch span, distributing the keys in two sets of 36 across the two keyboard sections 33 and 37. In certain embodiments, the width of the double-ended keyboard musical instrument may range between 36 inches and 54 inches and include a range of key elements split evenly or unevenly relative to each keyboard section. In one embodiment, the 72-key double-ended keyboard musical instrument may rest in a mahogany box for smooth sliding down the neck, marrying the dexterity of a keyboard play with the perception of a guitar. Multiple strap pegs may allow for the user to adjust the instrument for customizable weight distribution.

Device 10 is shown in FIG. 1 with first keyboard section 33 and second keyboard section 37, having keys arranged in opposite directions. By way of example, device 10 may be worn by a user (e.g., player, performer, etc.) such that the user's right hand operates with first keyboard section 33 and the user's left hand operates second keyboard section 37. In one embodiment, first keyboard section 33 is larger than second keyboard section 37. Although it should be appreciated that other key arrangements may be provided.

In one embodiment, as shown in the FIG. 1, the first keyboard section 33 includes a keyboard area 14 having a plurality of black keys 23 and white keys 17 held in a front face 41 thereof along a first side edge 42. In one embodiment, as shown in the drawings, the second keyboard section 37 includes a keyboard area 32 having a plurality of black keys 39 and white keys 40, held in front face 41 thereof along a first side edge 42. In certain embodiments, white keys 17 and 40 have a uniform key size and black keys 23 and 39 have another uniform key size. An opposite or second side edge 43 includes an open area whereupon the elevated keys of keyboard area 32 sit. An outer end 44 of second keyboard section 37 is preferably formed in a sleek, squared shape for counterbalance and to serve as support to the portion associated with keyboard 37. An inner or lower end 45 distributes equivalence to the right-handed user, supporting the second keyboard section 37, as explained more fully below. The keyboard sections include a plurality of electronic controls held in the front planar surface, such as surfaces 15 and 46, to enable a musician to play a variety of sounds with both keyboard sections.

The first or right hand positioned portion associated with first keyboard section 33 also may include controls, such as modulation controller 16, a pitch bending wheel 13, volume controls 20 and 21 and octave jumping controls 18 and 19. Such is also true of second keyboard section 37, its accompanying pitch bending wheel 12, and its same six settings as displayed in points 5, 6, 7, 8 and 9. In certain embodiments, buttons 20, 21, 18, 34 and 19 may be programmed as MIDI controllers, may switch between customized instruments, and may include one or more displays, eliminating the need to operate sound control functions from a computing device when performing live.

Five strap fasteners 22, 30, 31, 35 and 29 may be included on the rear surface to allow a shoulder strap to be secured at a customizable, desired position for comfort. A holding portion at the second end of first keyboard section 33 and the engaging portion at the first end of second supporting section 37 comprise customizable comfort by way of adjustable strap fasteners, such as fasteners 22, 30, 31, 35 and 29. In one embodiment, device 10 includes a plurality of finger controls held on the planar front surface of first keyboard section 33 and positioned so as to be easily accessible by a left hand or right hand of a musician when holding the first keyboard section 33.

Figure 4A:
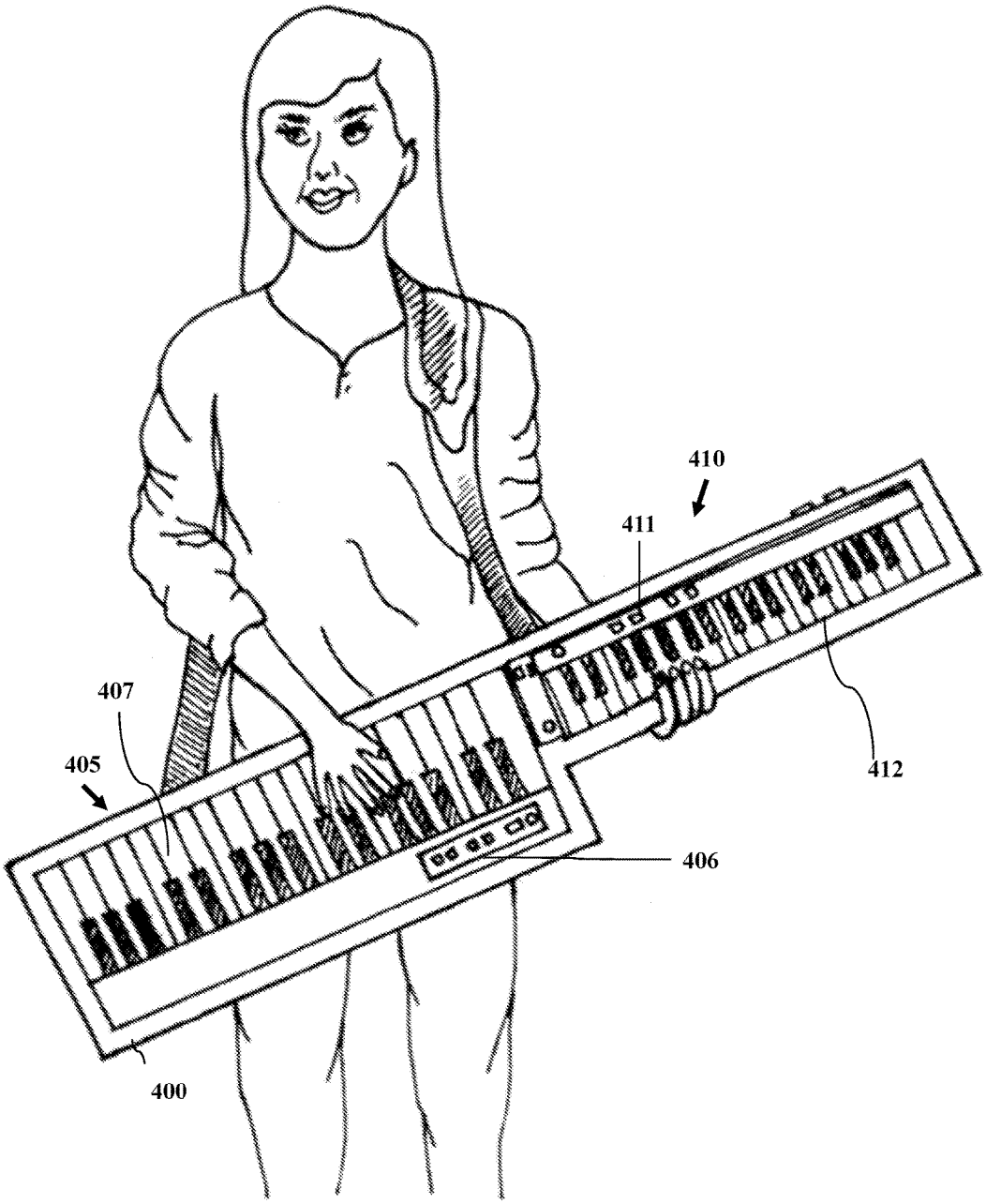
FIG. 4A is a perspective view of a musician holding the double-ended keyboard device according to one or more embodiments.
Figure 4B:
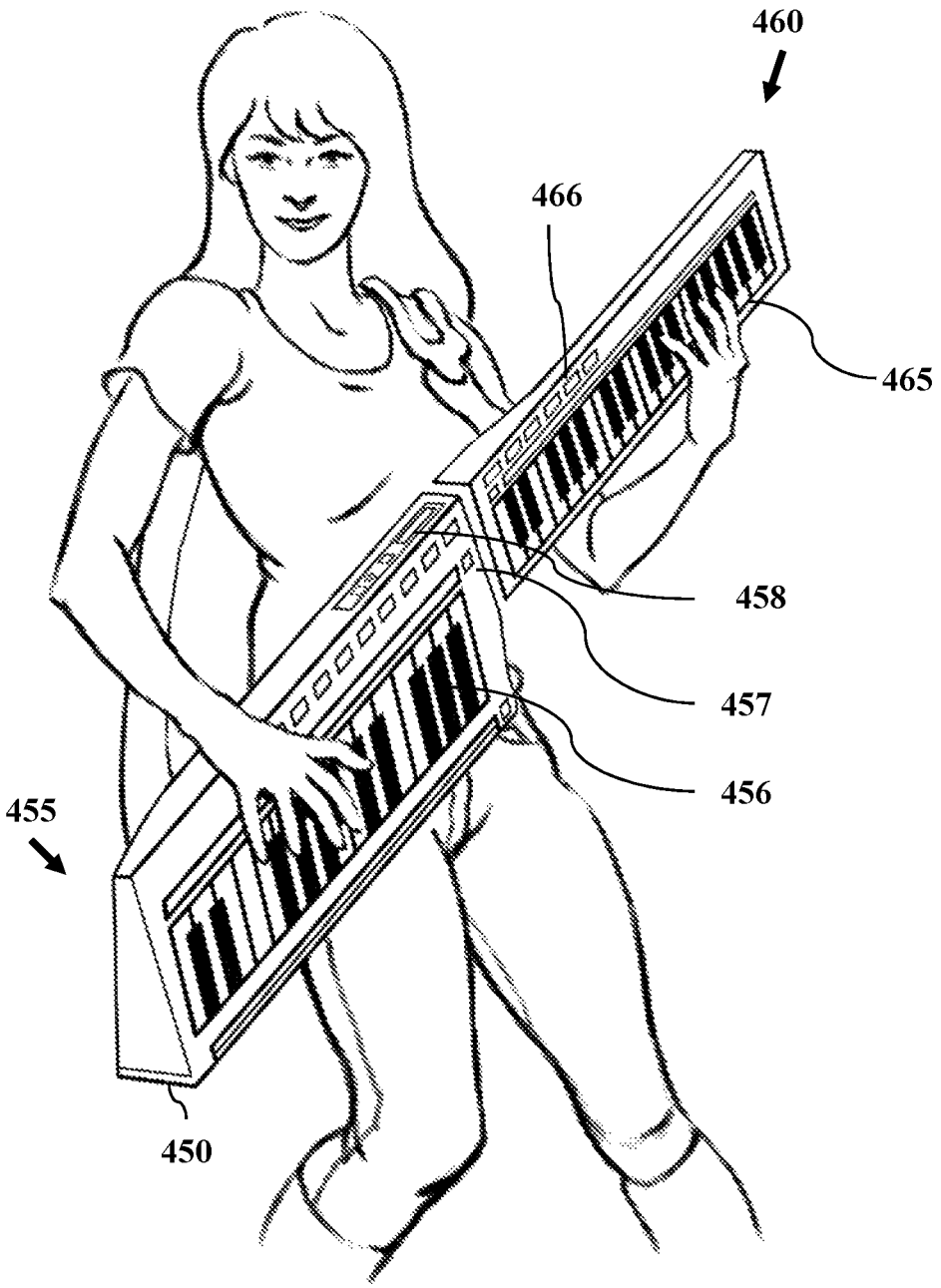
FIG. 4B is a perspective view of a musician holding a double-ended keyboard device according to one or more embodiments

According to another embodiment, device 10 includes a plurality of finger controls held on the planar front surface and planar rear surface of the first keyboard section. In one embodiment, the planar rear surface has a supportive and sleek base for easy right hand and left hand holding and sliding. The modulation 16 and pitch bending wheel 13 and the finger control 11 on the front surface and the finger or thumb controls, for octave jumping 18 and 19 on the rear surface, are ergonomically placed and sized and positioned so as to be easily reached and used by a musician holding the second keyboard section 37 in any playing position, such as shown in FIGS. 4A-4B. Controls of device 10 may also include one or more buttons/inputs to mute and un-mute the keyboards. In one embodiment, keyboard sections may be selectively muted using one or more inputs of device 10. In that fashion, accidental key presses due to user movement may be avoided.

According to one embodiment, device 10 provides a double-ended keyboard musical instrument to present range and ease to a user who wishes to have the freedom of an active guitarist. Device 10 can extend to each hand. According to one embodiment, keyboards of device 10 can operate independently, and control capabilities of the double-ended keyboard musical instrument allow the user to separate the sounds of the instrument using two different patches with the sound bank of their choice. In addition to bridging the gap fluidly between piano and guitar, device 10 bridges the gap between a single touch and the tone of every instrument in the world, on a live stage.

According to one embodiment, the double-ended keyboard musical instrument may also be modified for users who wish to play predominantly left-handed. Device 10 may be configured to switch the position and/or orientation of the top and bottom keyboards to accompany both left- and right-handed playing styles. In one embodiment, the double-ended instrument may be designed for right and left hand fluidity, with the option to reassign the keys contralaterally for intuitive playing after the user performs a "guitar-flip".

According to one embodiment, device 10 may be a MIDI instrument; the double-ended keyboard musical instrument may provide access to unlimited sound banks of the user's choice.

The double-ended keyboard musical instrument may include control devices, an electrical power source or adapters to be connected to a power source, and electronic components, including a pitch bender, octave modulator, volume control and MIDI modules for connection to or operation of various external devices. The double-ended keyboard musical instrument may be held horizontally and swiveled on its axis from about 45° to about 90°. The double-ended keyboard musical instrument may be left in a vertical position in a support stand or transported in a custom hard or soft carrying case. According to one embodiment, the double-ended keyboard may have an optional accompanying accessory of a comfortable memory foam attachable shoulder strap pad for additional comfort while playing.

While device 10 is shown in FIG. 1 with a particular configuration, it should be appreciated that device 10 may include one or more additional features and modifications as described herein.

Figure 2:
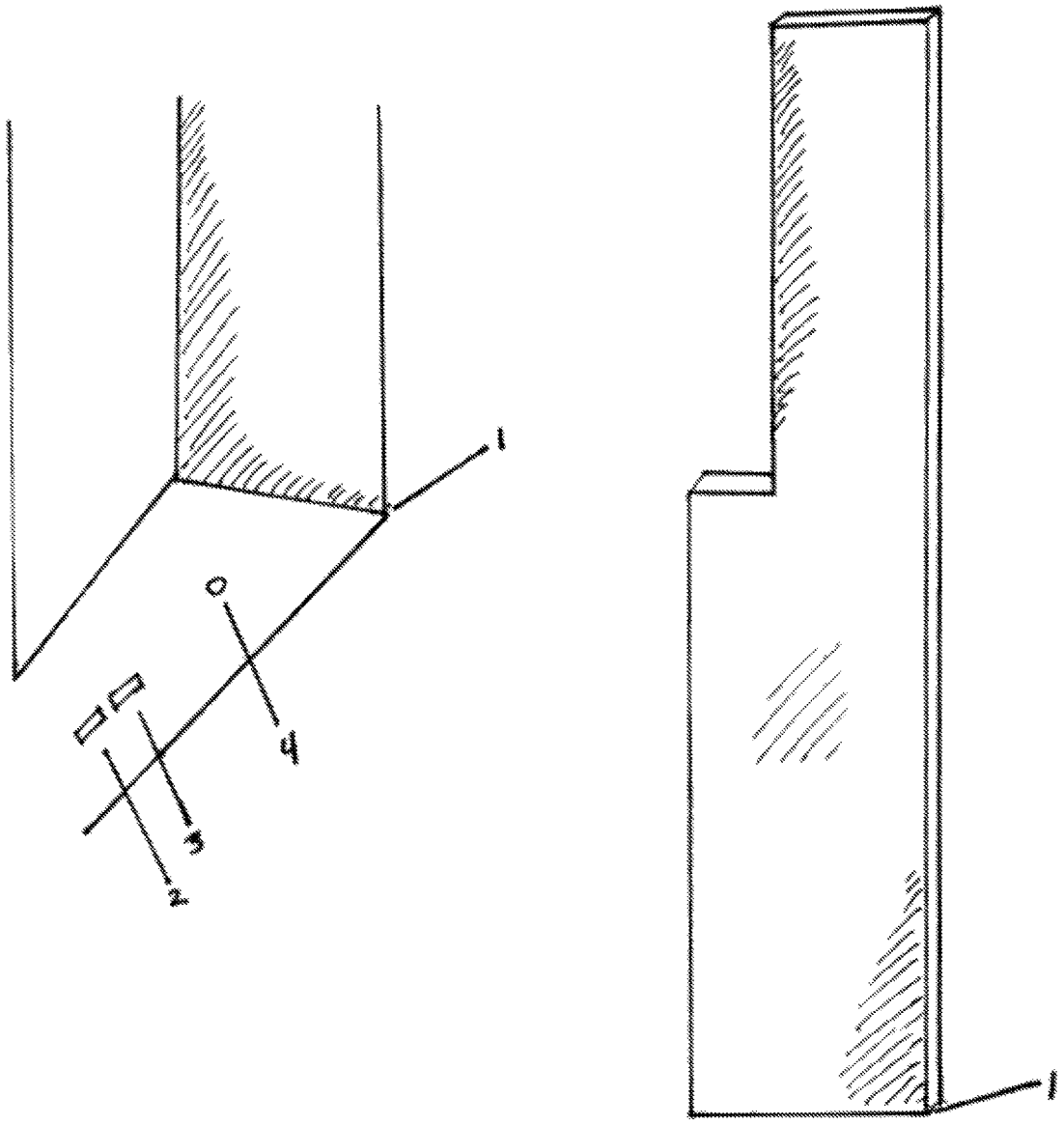
FIG. 2 is a rear elevational view of the device of FIG. 1 according to one or more embodiments.

FIG. 2 is a rear elevational view of the device of FIG. 1 held in vertical position with explained rear side. In FIG. 2, a device (e.g., device 10) is displayed by a rear view of the back of section 37 by way of point 1, two cavities for control interfaces 2 and 3 (e.g., MIDI control interfaces, USB, etc.) and a damper pedal cavity 4 for a damper pedal connector. Such versatility of the quarter-inch damper pedal cavity 4 can also be utilized in the event that the musician would like to use many pedals by way of a pedal board, such as a guitarist would use. In one embodiment, connection terminals of the device may include terminals for quarter inch cables, two MIDI cables, two USB inputs, and two damper pedals.

Figure 3:
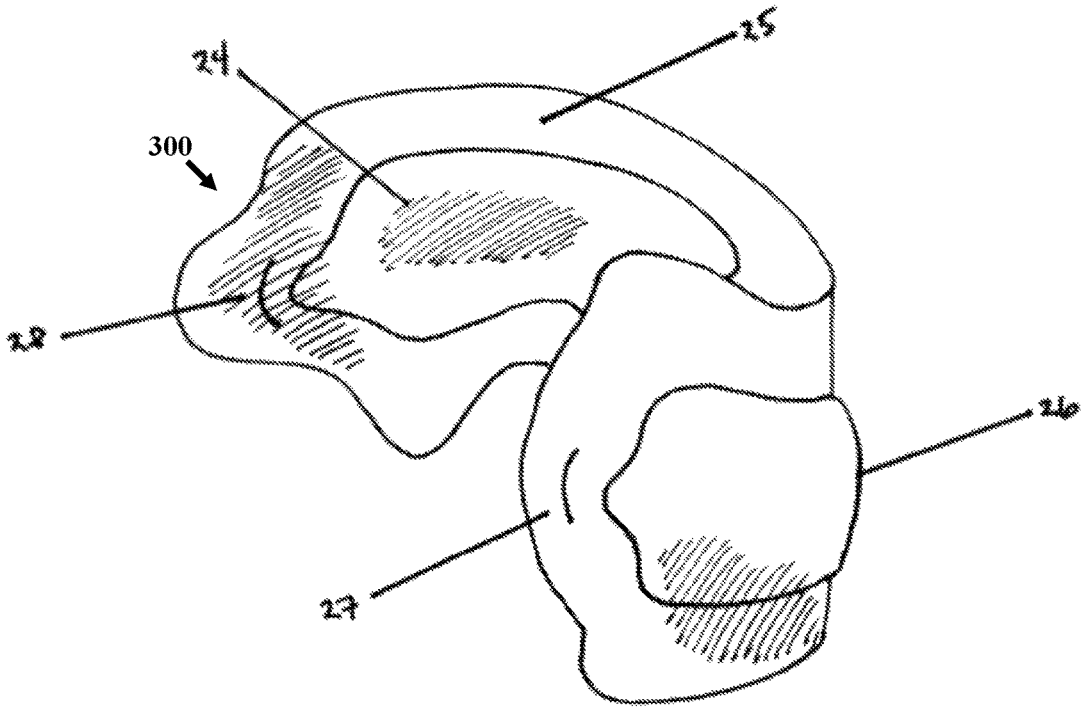
FIG. 3 depicts a graphical representation of a comfortable memory foam attachable shoulder strap pad according to one or more embodiments.

FIG. 3 depicts a graphical representation of a comfortable memory foam attachable shoulder strap pad which may be used with a device as described herein. Comfortable memory foam attachable shoulder strap pad 300 allows for individualized comfort to the highest degree as it can virtually fit any guitar strap of the user's choice by sliding through slots 27 and 28. In one embodiment, comfortable memory foam attachable shoulder strap pad 300 has a two-inch memory foam cushion 24 which allows comfort to extend over the shoulder and across the clavicle to the shoulder blade. In one embodiment, there is room for memory foam cushion 24 to breathe by way of a capacious pocket 26. In one embodiment, comfortable memory foam attachable shoulder strap pad 300 may be made to 100% vegan and cruelty free manufacturing standards using triple-strength faux leather material 25.

FIGS. 4A-4B depict user operation of a double-ended keyboard device according to one or more embodiments. Referring first to FIG. 4A, a perspective view of a user (e.g., musician, performer, etc.) is shown holding the double-ended keyboard device 400 in a playing position, with a comfortable memory foam attachable shoulder strap pad attached to an ordinary guitar strap attached to the rear of the keyboard portion and suspended over the musician's shoulder. Double-ended keyboard device 400 includes first section 405 including a first keyboard and second section 410 including a second keyboard. Control interface 406 may be configured to provide one or more controls for first keyboard 407 of first section 405. In a similar fashion, control interface 411 may be configured to provide one or more controls for second keyboard 412 of second section 410.

Control interfaces 406 and 411 can include one or more tone selection and effects controls. According to one embodiment, control interfaces 406 and 411 may control a single keyboard, such that control interface 406 controls first keyboard 407 and control interface 411 controls first keyboard 412. However, it should be appreciated that device 400 may allow for either of control interfaces 406 and 411 to control first keyboard 407 and second keyboard 412. Although first and second are used to describe keyboards of device 400, references to first and second are only for identification. FIG. 4A depicts device 400 control interfaces 406 and 411 associated each with a different axis along the body lines of device 400.

FIG. 4B shows a user (e.g., musician, performer, etc.) having a double-ended keyboard device 450 in a playing position, with the device worn. Double-ended keyboard device 450 includes first section 455 including a first keyboard 456 and second section 460 including a second keyboard 465. Control interface 457 may be configured to provide one or more controls for first keyboard 456 of first section 455. In a similar fashion, control interface 466 may be configured to provide one or more controls for second keyboard 465 of second section 460. According to one embodiment, first section 455 includes an additional control surface 458 associated with a side or plane portion of first section 455 that is near the user and can be seen while operating the device.

Control interfaces 457, 458 and 466 can include one or more tone selection and effects controls. According to one embodiment, control interfaces 457, 458 and 466 may control a single keyboard, and/or allow for either of first keyboard 456 and second keyboard 460. FIG. 4B depicts device 450 with control interfaces 457 and 466 associated each with a same axis along the body lines of device 450.

In FIG. 4B the musician's right hand can play first keyboard 455 and the users left hand can come from underneath the device in a supinated grip (e.g., palm rotated out and facing the user) to play second keyboard 460.

According to one embodiment, double-ended keyboard device 450 can allow for first section 455 including a first keyboard 456 and second section 460 including a second keyboard 465 to swivel.

Figure 5:
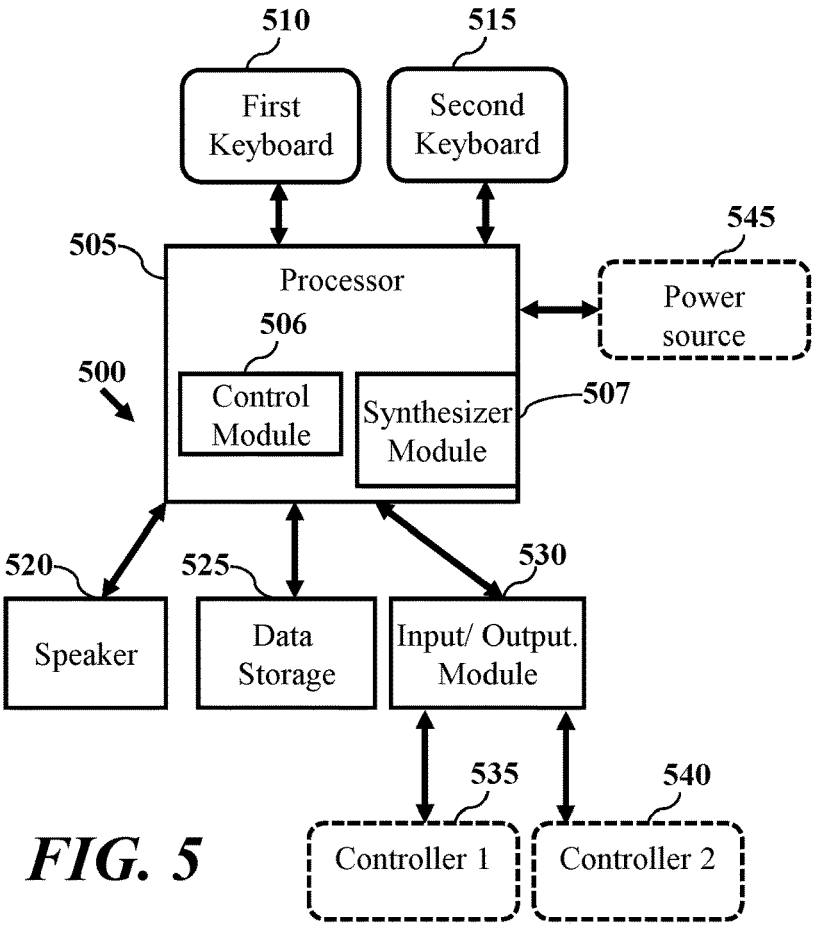
FIG. 5 depicts a graphical representation of device components according to one or more embodiments.

FIG. 5 is a graphical representation of device components according to one or more embodiments. According to one embodiment, device 500 relates to a keyboard device including one or more components. Device 500 may be configured to allow for a first and second keyboard according to one or more embodiments. Device 500 includes processor 505, first keyboard 510, second keyboard 515, speaker 520, data storage unit 525, and input/output module 530. According to one embodiment, device 500 may interoperate with one or more other control units such as controllers 535 and 540 which may including one or more of foot switches, foot pedals, and control units in general.

According to one embodiment, first keyboard 510 and second keyboard 515 each include a plurality of keys, such as piano style keys, hinged keys, etc. According to another embodiment, the keys of first keyboard 510 and second keyboard 515 may serve multiple functions. By way of example, each key of first keyboard 510 and second keyboard 515 can be configured to provide at least one of an activation function, pitch bending function, pitch shifting, harmony control, chord control and volume control. Keys of first keyboard 510 and second keyboard 515 may each include one or more contact points and activation areas that allow for activation, sliding (potentially in one or more directions) and triggering functions of the keys. Key functions may be assigned based on one or more user settings to device 500.

According to one embodiment, processor 505 includes a control module 506 configured to detect operation of first keyboard 510 and second keyboard 515. According to one embodiment, detected key presses of first keyboard 510 and second keyboard 515 may be detected and result in output of control signal an/or sound by control module 506 to input/output module 530 and/or speaker 520. In certain embodiments synthesizer module 507 of processor 505 generates and/or modifies output based on detected operation of keyboards 510 and 515 and one or more user selections. In one embodiment, at least one of control module 506 and synthesizer module 507 may generate output based on 64 built-in tones, 128-voice polyphony, and a 3-character LED display. As discussed below with reference to FIG. 12, and process 1235 the amount of tones for the keyboard device and for use by processor 505 may be increased and/or reduced relative to 64 built-in tones and 128-voice polyphony tones. Output may be based on one or more settings of input/output module 530 on device 500, such as inputs to a touchpad-like pitch bend ribbon, expression bar, sustain switch, and volume control knob. Data storage 525 may store a sound bank of hundreds of traditional and unique instruments, filters, templates and presets (such as a modulator, arpeggiator and reverb). In one embodiment, control module 506 may allow for sound patches stored by data storage 525 to be updated and/or changed. Data storage 525 may provide memory to store sound patches on the body (e.g., internal storage of device 500). In certain embodiments, device 500 may output signals in the form of MIDI control signals which may be run through a device running one or more software applications.

Input/output module 530 may be associated with one or more input terminals, buttons, and control interfaces of device 500. Device 500 may include a vibrato bar (e.g., vibrato lever) to be positioned near the first and second keyboards 510 and 515 for pitch bending. In addition to a vibrato bar, device 500 may include a sensory strip along the bottom of each keyboard which may allow for pitch bending and/or vibrato. By way of example, pitching bending in either direction (to the right will move the pitch up, to the left will move the pitch down) may be provided based on the location of the input commands relative to a section of the keyboard.

According to another embodiment, one or more controllers may be used with first keyboard 510 and second keyboard 515. In one embodiment, controllers 535 and 540 may each relate to damper pedals to sustain the sound of first keyboard 510 and second keyboard 515, respectively. According to one embodiment, each controller may independently control a single keyboard by way of input/output module 530.

According to one embodiment, device 500 may be powered by a power source, such as power source 545. In certain embodiments, power source 545 may relate to a rechargeable battery pack retained by a body of the electronic device. In other embodiments, power may be provided to device 500 by a connection to an external power source by way of a cable. In other embodiments, power source 545 may include one or more photovoltaic cells (e.g., solar cells) and storage units (e.g., batteries) that may be configured to power device 500.

Figure 6:
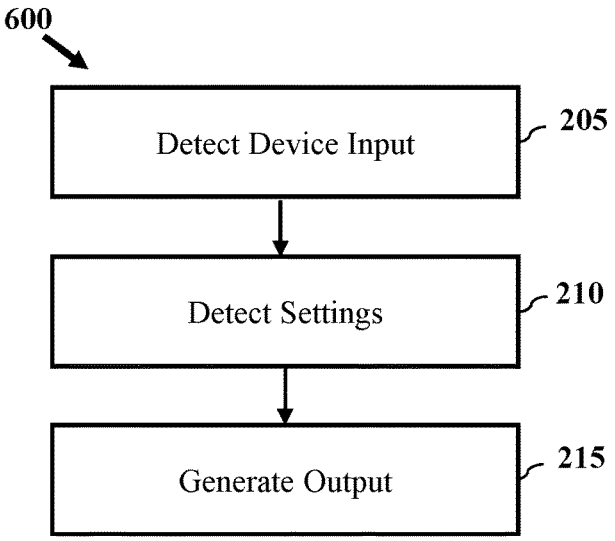
FIG. 6 depicts a process for operation of a double-ended device according to one or more embodiments.

FIG. 6 depicts a process for operation by a double-ended device according to one or more embodiments. Process 600 may be initiated by detecting device input at block 605. Device input may be based on detected activations of a first and second keyboard (e.g., first and second keyboards 510, 515). Detecting input to the first keyboard section and second keyboard section can include detecting input piano keyboard key arrangements having a plurality of keys, wherein each key is associated with a tone. Detecting input to the first keyboard section and second keyboard section can include detecting input to a plurality of elongated hinge keys, wherein each key is detected as an independent control input.

At block 610, one or more device settings may be detected. Device settings may be configured to set the tones of each keyboard individually, the sound bank used for each keyboard and one or more user settings to modify sound settings. At block 615, the device generates output. In one embodiment, output may be in the forms of one or more control signals, which may be formatted according to one or more machine formats (e.g., MIDI, etc.). According to another embodiment, the device may output sound signals at block 615 in addition to, or separate from control signal output. Controlling output for the double-ended keyboard device can include aggregating detected inputs and control settings for providing output to the output interface.

FIGS. 7A-7D depict graphical representations of device rotation configurations and mechanisms for implementing such according to one or more embodiments. According to one embodiment, a double-ended keyboard device 700 is configured to allow for rotation of a first keyboard section 705 including a first keyboard relative to a second keyboard section 710 including a second keyboard.

Figure 7A:
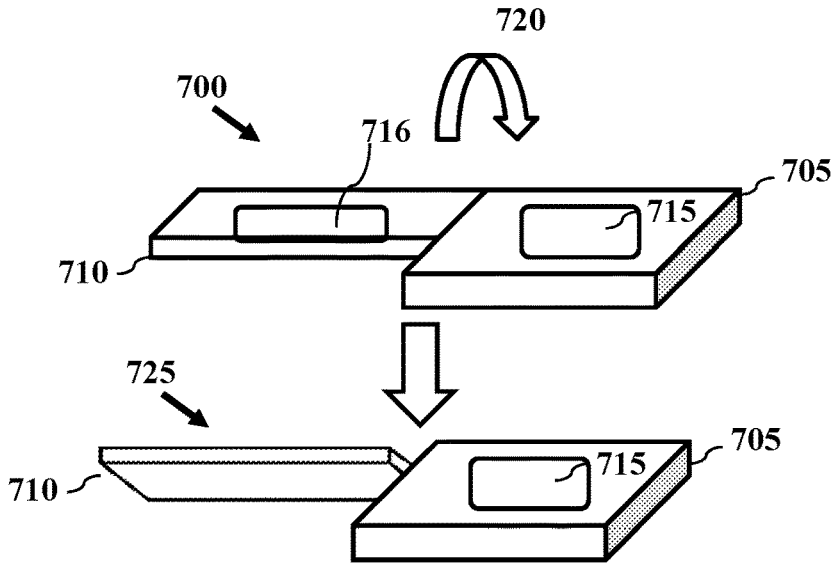
FIGS. 7A-7B depict graphical representations of device rotation configurations and mechanisms for implementing such according to one or more embodiments.

FIG. 7A depicts rotation of second keyboard section 710 as show generally by direction 720 to a rotated position 725. In one embodiment, rotation may be provided by a swivel mechanism 712 joining first keyboard section 705 to second keyboard section 710. In one embodiment, swivel mechanism 712 is a swivel-and-lock mechanism which allows for holding the two keyboard sections 705 and 710 at a fixed angle relative to each other.

Figure 7B:
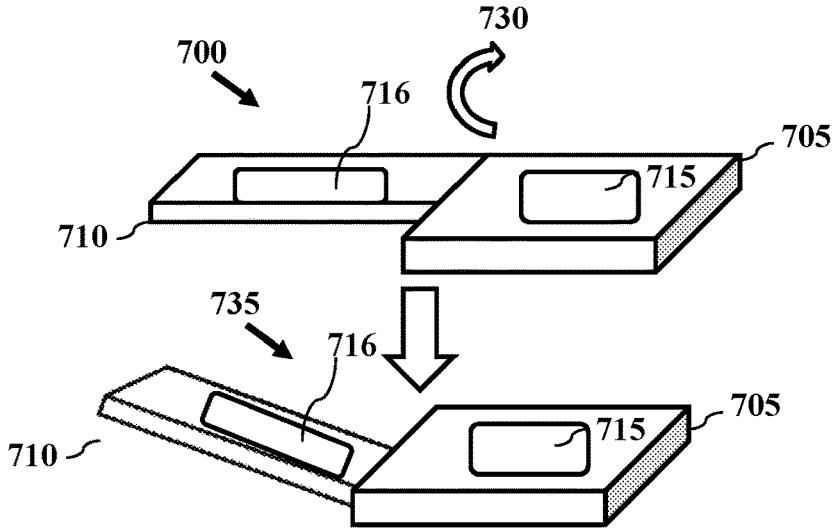

In FIG. 7B, a double-ended keyboard device 700 is configured to allow for pivoting of a first keyboard section 705 including a first keyboard relative to a second keyboard section 710 including a second keyboard. FIG. 7B depicts pivoting of second keyboard section 710 as shown generally by direction 730 to a pivoted position 735.

According to one embodiment, double-ended keyboard device 700 may provide a box shape, in which a hinge which runs along the top of the right hand or larger-keyed portion embodied by first keyboard section 705 which allows the smaller second keyboard section 710 (e.g., top portion) to swing its exposed side back and click onto the hinge, thus running a larger keyboard facing the user and a smaller keyboard facing away for left hand wrist comfort. According to one embodiment, this arrangement is inverted for a left-handed double-ended keyboard instrument.

According to one embodiment, device 700 includes a compartment 715 which may be configured to receive and store a portable computing device, such as a tablet which may be configured to interoperate with device 700. In one embodiment, when device 700 is a control device, the portable computer may be configured to receive key presses to direct an application. In other embodiments, the portable computing device may record music and/or sound output generated using device 700. The portable computer may run one or more patches directly into the keyboards. Compartment 715 may eliminate the need to rely on a laptop on stage separately located from the device.

According to another embodiment, a keyboard device may include one or more keys on the back of the keyboard body. In one embodiment, device 700 includes a key section 716 including at least one key which may allow for activation and may allow for wrap around activation by a user's thumb. Use of a thumb allows for device 700 to mimic guitar style play where a user's hand wraps around a body of the device 700, such as second keyboard section 710. Key section 716 can include an entire keyboard section (e.g., one or more octave of keys, etc.). In another embodiment, key section 716 may include one or more keys which may be assigned tones based on a pitch modulator button of device 700. Key section 716 can be muted and in some embodiments all keys of key section 716 may be locked in position. According to yet another embodiment, key section 716 can also be rotated out from top section/second keyboard section 710 to allow the user to play an additional third keyboard, which can be swiveled and locked into position while playing.

According to one embodiment, swivel mechanism 712 may have a stopper mechanism to limit rotation. Angle stopper channel 770 may be configured to receive angle stopper peg 775. In one embodiment, the rotational motion of second keyboard section 710 relative to first keyboard section 705 may be limited to the arc defined by angle stopper channel 770.

In another embodiment, magnet sets 740 and 745 are spaced in a circle around the axis of hollow pipe 767 such that they define a number of available fixed angles of rotation between first keyboard section 705 and second keyboard section 710.

FIGS. 7A-7D also depict an embodiment where second keyboard section 710 includes a thinner neck/body style in comparison to the body of first keyboard section 705. A thinner neck may allow for a user's hand to wrap around the back side of a keyboard device.

Figure 8A:
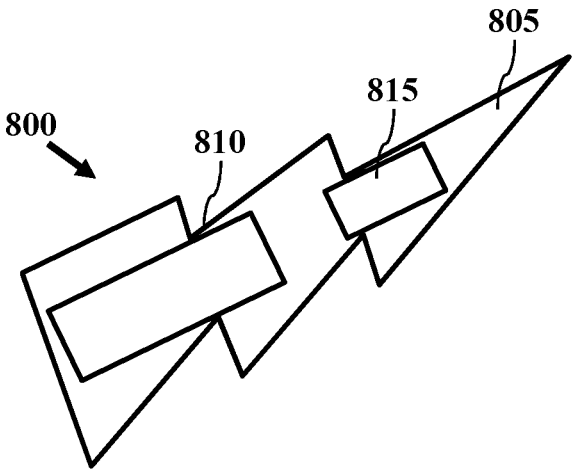
FIGS. 8A-8C depict graphical representations of device shape configurations according to one or more embodiments.
Figure 8B:
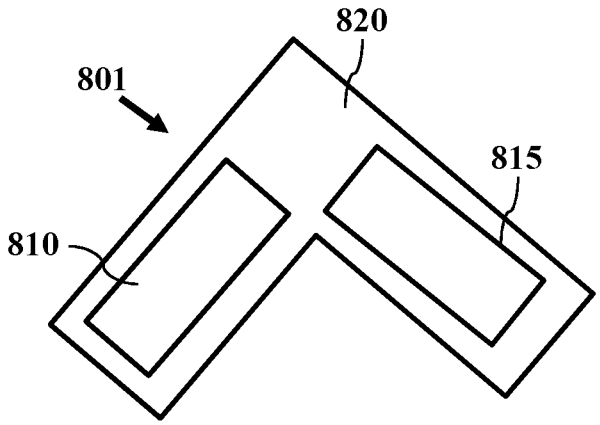
Figure 8C:
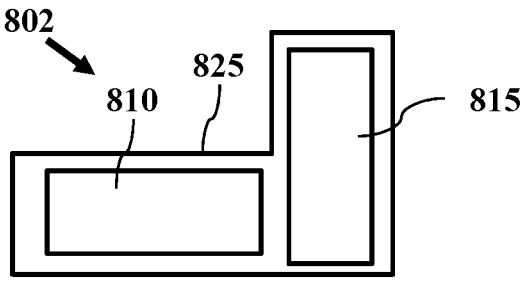

FIGS. 8A-8D depict graphical representations of device shape configurations according to one or more embodiments. According to one embodiment, electronic keyboard devices as described herein may include first and second keyboards configured to allow for a wearable configuration with one or more body shapes. A double-end keyboard device may include one or more body types and different body shapes. The body of each device may include one or more custom colors, patterns and bling for each body shape. Custom materials may be used for each body, other than standard wood (e.g., mahogany), including but not limited to plastic, vinyl, pine wood, oak wood, aluminum and glass. Double-ended keyboards as described herein may employ a traditional box shape with variations, such as one or more of rounded edges for a smooth, sleek shape, an "S" shape body, and an unlimited variety of stains, lacquers and wraps available. The body types may be generated by printing with a CNC process using any desired material. Keyboard devices may also include customized hard shell touring cases, rated for durability with recessed locks and butterfly clips. FIGS. 8A-8C depict graphical representations of the top side of a device, the top side including a plurality of keyboards.

FIG. 8A depicts device 800 including body 805 with first keyboard 810 and second keyboard 815. According to one embodiment, first keyboard allows for operation by a right hand and second keyboard allows for operation by a left hand positioned underneath body 805. According to another embodiment, the first and second keyboards 810 and 815 are housed in a lightning bolt body 805. Body 805 may be a lightning bolt shape, where the keys are running in any direction along the board accordingly.

FIG. 8B depicts device 801 including v-shaped body 820 with first keyboard 810 and second keyboard 815. According to one embodiment, first keyboard 810 allows for operation by a right hand and second keyboard 815 allows for operation by a left hand, wherein a user holding their arms to the side with fingers pointing in allows for operation.

FIG. 8C depicts device 803 including L-shaped body 825 with first keyboard 810 and second keyboard 815. According to one embodiment, first keyboard 810 allows for operation by a right hand and second keyboard 815 allows for operation by a left hand, wherein a user holding their left arm to the side with fingers pointing in allows for operation of keyboard 815. L-shaped body 825 may include a second keyboard 815 on the left side at a 90-degree angle from first keyboard 810. This can allow the thumb to be used on the left hand while still holding device 802 like a guitar. The second keyboard 815 could also be used to make repeated notes easier.

Figure 8D:
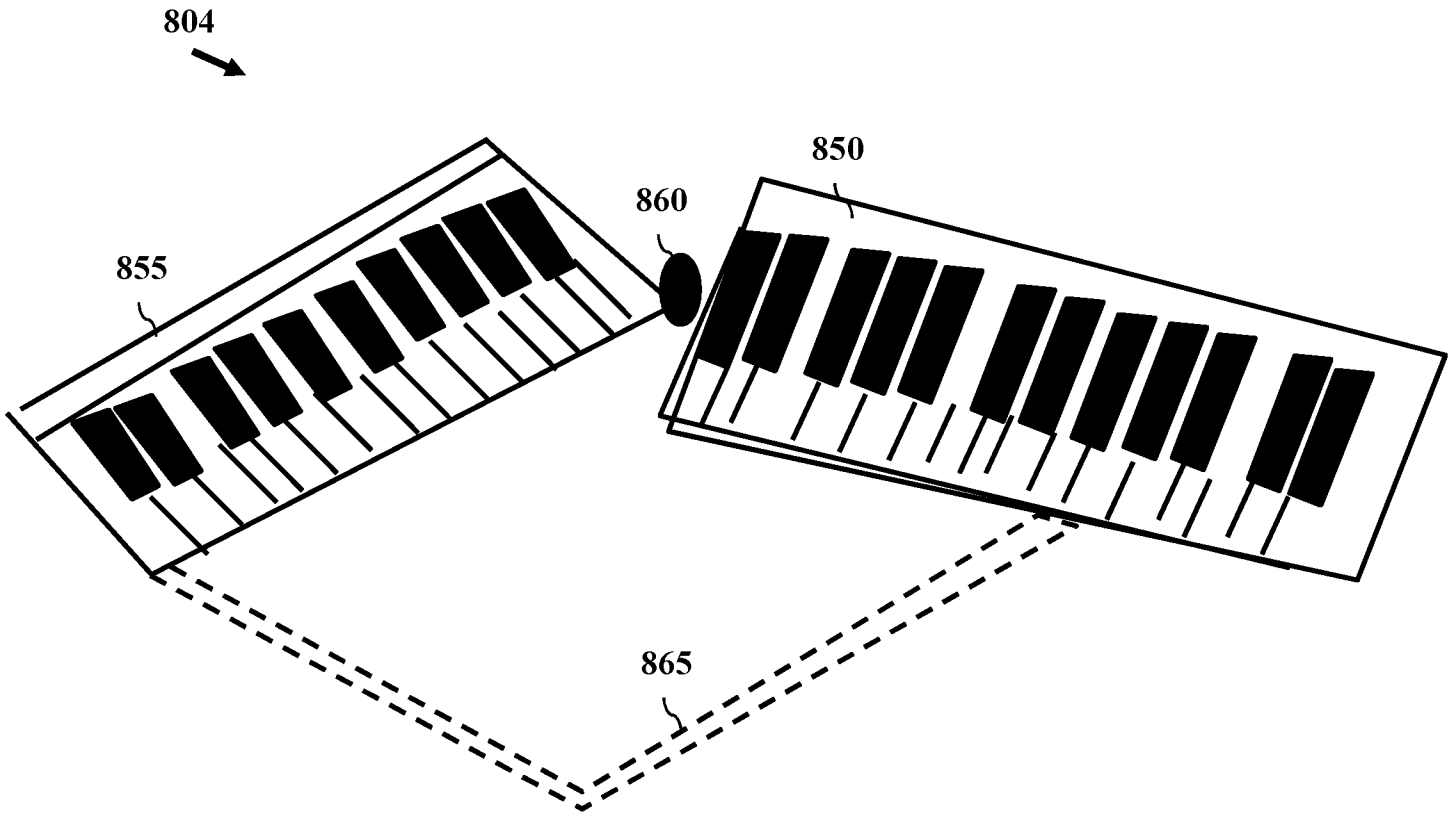
FIG. 8D depicts a graphical representation of a device configuration according to one or more other embodiments.

FIG. 8D depicts device 804 including first keyboard 850 and second keyboard 855. According to one embodiment, first keyboard 850 allows for operation by a right hand and second keyboard 855 allows for operation by a left hand, wherein keys of each keyboard face the same direction. According to one embodiment, a joint of device 804 is configured to support a lateral portion of second keyboard 855 to a lateral portion of first keyboard 850. The v-shaped body of device 804 may include a user to see both keys while still allowing for a rotating joint 860. Device 804 may represent a left hand keyboard neck, second keyboard 855, configured to tilt from side to side, and thus, is slightly diagonal and not parallel to first keyboard 850.

Optional strap 865 may be configured to support first keyboard 850 and second keyboard 855. Optional strap 865 may be worn over the user's shoulder and or neck.

Figure 9A:
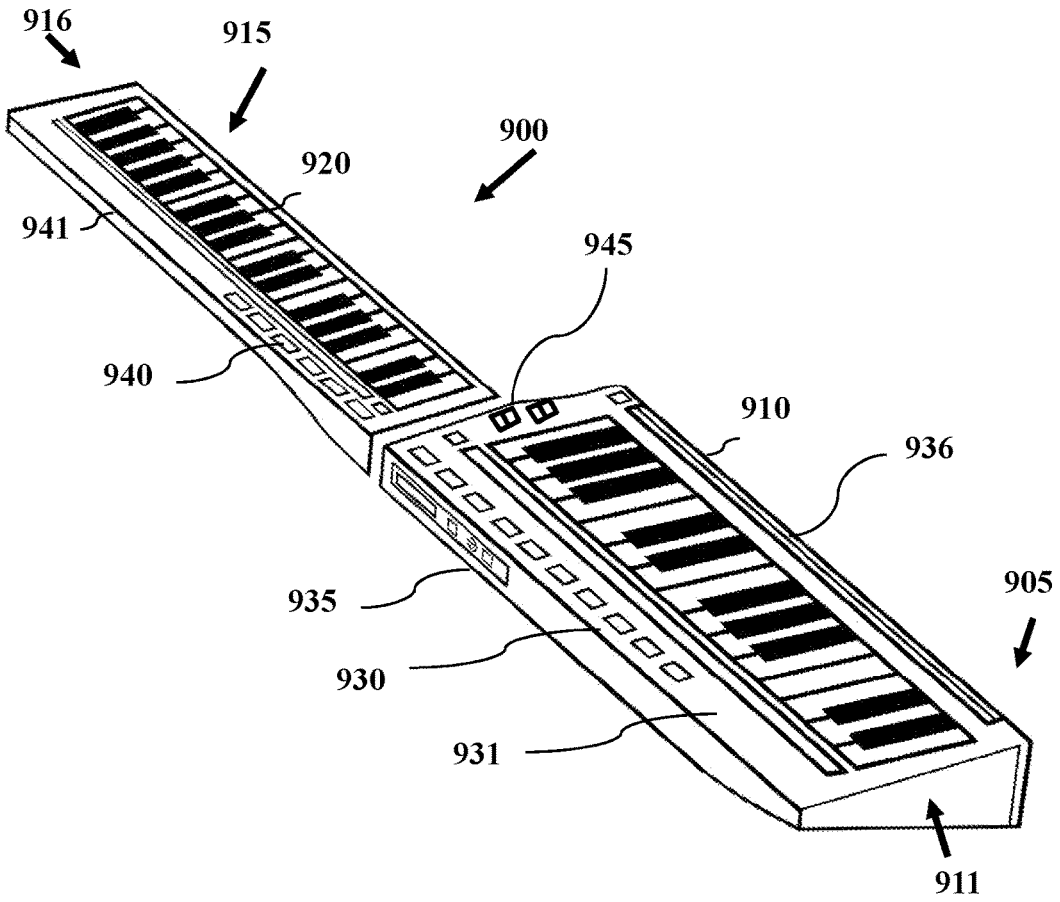
FIGS. 9A-9E depict graphical representations of device configurations according to one or more embodiments.

FIG. 9A shows a double-ended keyboard device 900. Double-ended keyboard device 900 includes first section 905 including a first keyboard 910 and second section 915 including a second keyboard 920. Control interface 930 may be configured to provide one or more controls for first keyboard 910 of first section 910. In a similar fashion, control interface 940 may be configured to provide one or more controls for second keyboard 920 of second section 915. According to one embodiment, first keyboard 910 includes an additional control surface 935 associated with a side or plane portion of first section 905 that can be seen while operating the device. Control interfaces 930, 935 and 940 can include one or more tone selection and effects controls. According to one embodiment, control interfaces 930, 935 and 940 may control a single keyboard, and/or allow for either of first keyboard 910 and second keyboard 920. FIG. 9A depicts device 900 with control interfaces 930 and 940 associated each with a same axis along the body lines of device 900. In addition, the planar surfaces of device 900 supporting control interfaces 930 and 940 may flush when device is not rotated such that surface 931 of first section 905 and surface 941 of second section 915 are not only aligned along the same axis but also may be aligned in height. Operation of device 900 may similar to operation of the device shown in FIG. 4B.

In FIG. 9A, the first section 905 including a first keyboard 910 may relate to a first housing and second section 915 including a second keyboard 920 may relate to a second housing. In one embodiment, the first section 905 section and second section 915 each include a piano keyboard key arrangement having a plurality of keys, wherein each key is associated with a tone. According to another embodiment, the first section 905 section and second section 915 together provide a sequential set of tone inputs for the double-ended keyboard device. The first section 905 section and second section 915 can each include a plurality of elongated hinge keys, In one embodiment, each key is detected as an independent control input. According to another embodiment, first section 905 including a first keyboard 910 is associated with right hand operation, second section 915 including a second keyboard 920 is associated with left hand operation, and the double-ended keyboard device is configured to be worn by a user. First section 905 includes a housing control surface and the second housing control surface are arranged along a shared axis. The first section 905 and second section 915 include planar top surfaces for the control interface. The double-ended keyboard device 900 includes a control unit configured to generate sound output for detected input to each of the first keyboard section and second keyboard section. In certain embodiments, the control unit is configured to generate control output for detected input to each of the first keyboard section and second keyboard section. The output interface includes at least one of a single ended input, stereo output, control interface terminal and terminals for at least one external device. The control unit is configured to generate output for the first keyboard section independent from the second keyboard section and generate output for the second keyboard section independent from the first keyboard section.

A control unit of device 900 may be configured to detect input to each of the first housing and the second housing. Inputs to each of the first and second housing may relate to key presses of first keyboard 910 and second keyboard 920, as well as settings of control interfaces 930, 935 and 940. Control interfaces 930, 935 and 940 may relate to one or more controls, inputs and interface elements. Control interfaces 930, 935 and 940 may provide independent sound banks, selection and control of the sound banks and desired output characteristics. The control unit may be configured to generate output in response to the input of each of first keyboard 910 and second keyboard 920, and control interfaces 930, 935 and 940 such that a selected sound bank of control interfaces 930, 935 and 940 may set the tone, output sound or control setting for each of first keyboard 910 and second keyboard 920. The first section 905 including a first keyboard 910 may include at least one pitch wheel. FIG. 9A shows a pair of pitch wheels, such as pitch wheel 945, which may be located in the center of the keyboard and used to control both the first keyboard 910 and second keyboard 920. First section 905 includes a gliss strip 936.

Keys of first keyboard 910 and second keyboard 920 may be arranged from low to high pitch, similar to a piano, such that the key near end 911 is the lowest key of first keyboard 910. Similarly, the key nearest end 916 is the highest key of second keyboard 915. The sequence or pitch direction can be controlled or switched. In some embodiments, first keyboard 910 and second keyboard 920 may each be arranged in independently. For example, the key nearest end 916 is may be the lowest key of second keyboard 915. In certain embodiments, the double-ended keyboard device 900 may include a feature (e.g., guitar flip feature) wherein the sequence of pitch and tone for second keyboard 920 may be arranged depending on how the player prefers to play second keyboard 920.

Figure 9B:
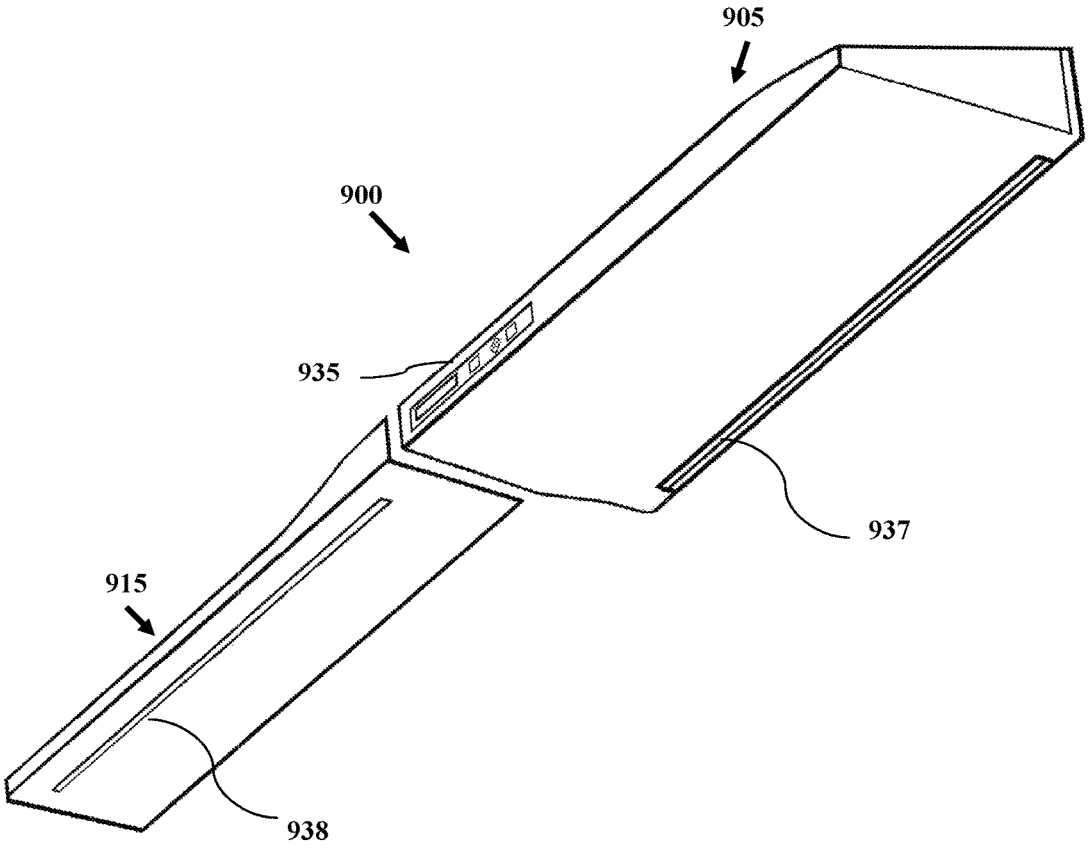

FIG. 9B illustrates the back surface of device 900 including first section 905 and second section 915. The back surface of device 900 may be a smooth or contoured surface. Control surface 935 is visible from a plan view of device 900. FIG. 9B is a view of first keyboard section 905 and second keyboard section 915 while the two sections are rotated to a non-zero relative angle. As such the back or bottom surface of first keyboard section 905 and second keyboard section 915 may be flush or substantially planar in some embodiments.

According to one embodiment, the back of first section 905 and second section 915 may each include a gliss strip. As shown, back of first section 905 includes gliss strip 937 and second section 915 includes a gliss strip section 938.

Figure 9C:
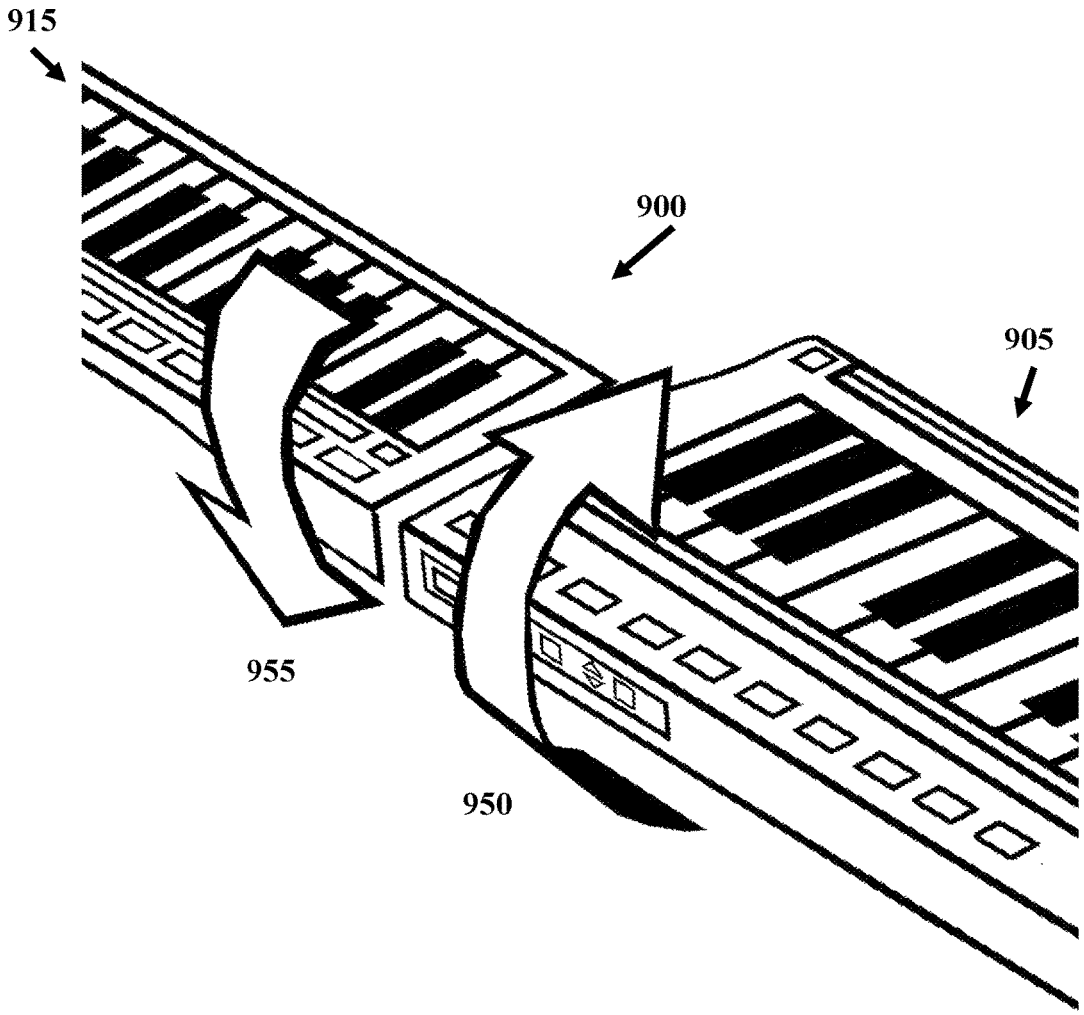

FIG. 9C shows an enlarged view of detailed graphical representation of first keyboard section 905 and second keyboard section 915 while the two sections are configured to be rotated to a non-zero relative angle. According to one embodiment, first keyboard section 905 and second keyboard section 915 may be configured to rotate relative to one another, such as by way of a joint between the two housings that allows for rotation relative to an axis of the housings. Exemplary rotations directions are shown by 950 and 955. In certain embodiments, the first keyboard section 905 and second keyboard section 915 may each rotate in a clock wise and/or counter clockwise direction. As described herein rotation of the first keyboard section 905 and second keyboard section 915 allows for full and complete rotation such as a swivel joint may be provided that allows for free rotation. In other embodiments, the first keyboard section 905 and second keyboard section 915 may be rotated to a desired position and locked or fixed in place using a joint between the first keyboard section 905 and second keyboard section 915. According to one embodiment, the joint secures first section 905 including a first keyboard 910 (the first housing) and second section 915 including a second keyboard 920 (the second housing) second housing. The joint operates to provide rotation of the first housing relative to the second housing along an axis associated with first housing and second housing. The joint includes a shaft received by each of the first housing and the second housing, and a cam configured to secure a rotational arrangement of the first housing relative to the second housing. The joint provides/allows for rotation and for fixed locking position of housing relative to a body line. In one embodiment, the joint receives a communication interface from a keyboard section to the controller.

Figure 9D:
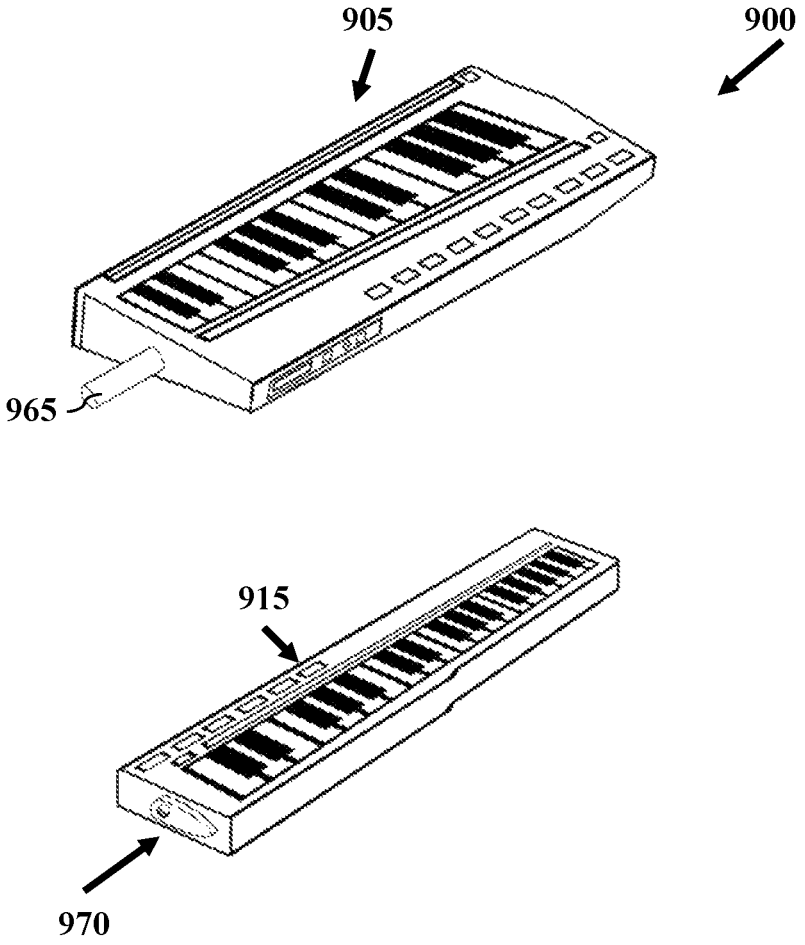

FIG. 9D shows a separated view of first keyboard section 905 and second keyboard section 915, wherein first keyboard includes a shaft 965 and second keyboard includes a cam 970. According to one embodiment, can 970 may be securely mounted to shaft 965.

Figure 9E:
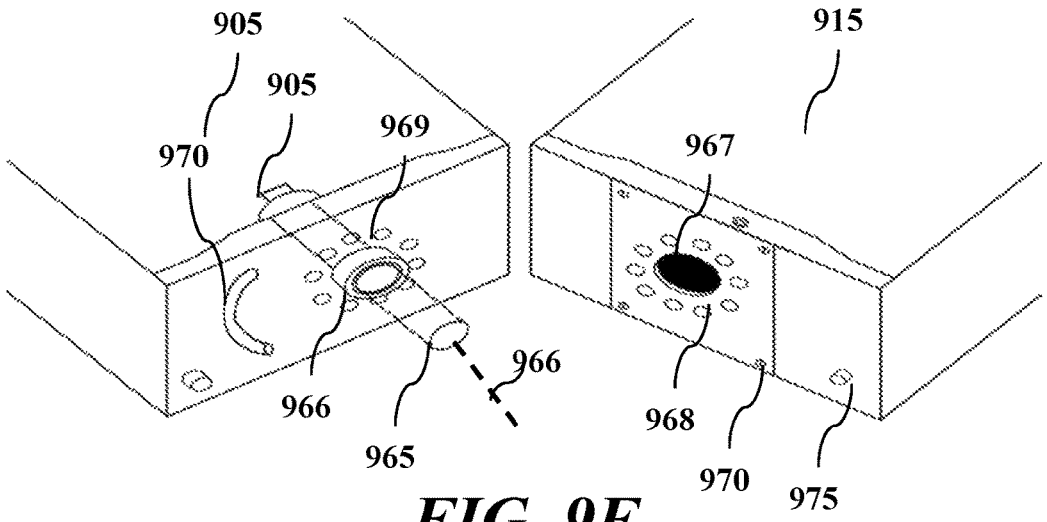

FIG. 9E shows a graphical representation of joint which may provide a rotating and/or swivel connection. First keyboard section 905 and second keyboard section 915 may revolve around shaft 965 which may be a hollow pipe. According to one embodiment, shaft 965 may contain one or more wires running between first keyboard section 905 and second keyboard section 915. Affixed shaft 965 is ball bearing 966, which may be configured to allow smooth rotation around the joint. In one embodiment, shaft 965 may connect to second keyboard section 915 by connector socket 967. In one embodiment, magnet sets 968 and 969 may affix first keyboard section 905 to second keyboard section 915 while allowing for rotation. The end of first keyboard section 905 facing second keyboard section 915 may have metal plate 970 affixed to it. According to one embodiment, the end of second keyboard section 915 facing first keyboard section 905 may include set screw 975 to secure the components of second keyboard section 915 to a channel 970. In certain embodiments, the magnetic joint including one or more features of FIG. 9 may operate with a cam locking swivel joint. According to one embodiment, shaft 965 may allow for an optional cable 966 to link a control unit to one or more keyboards or control interfaces. In one embodiment, cable 966 may provide data for keyboard presses and toggle button selections of a keyboard on a second housing, where the control unit is located on a first housing. The control unit may be configured to detect input to each of the first housing and the second housing and to generate output in response to detected input. Device 900 may include an output interface coupled to the control unit, the output interface configured to provide output for the double-ended keyboard device in response to input to at least one of the first keyboard section and the second keyboard section.

Figure 10A:
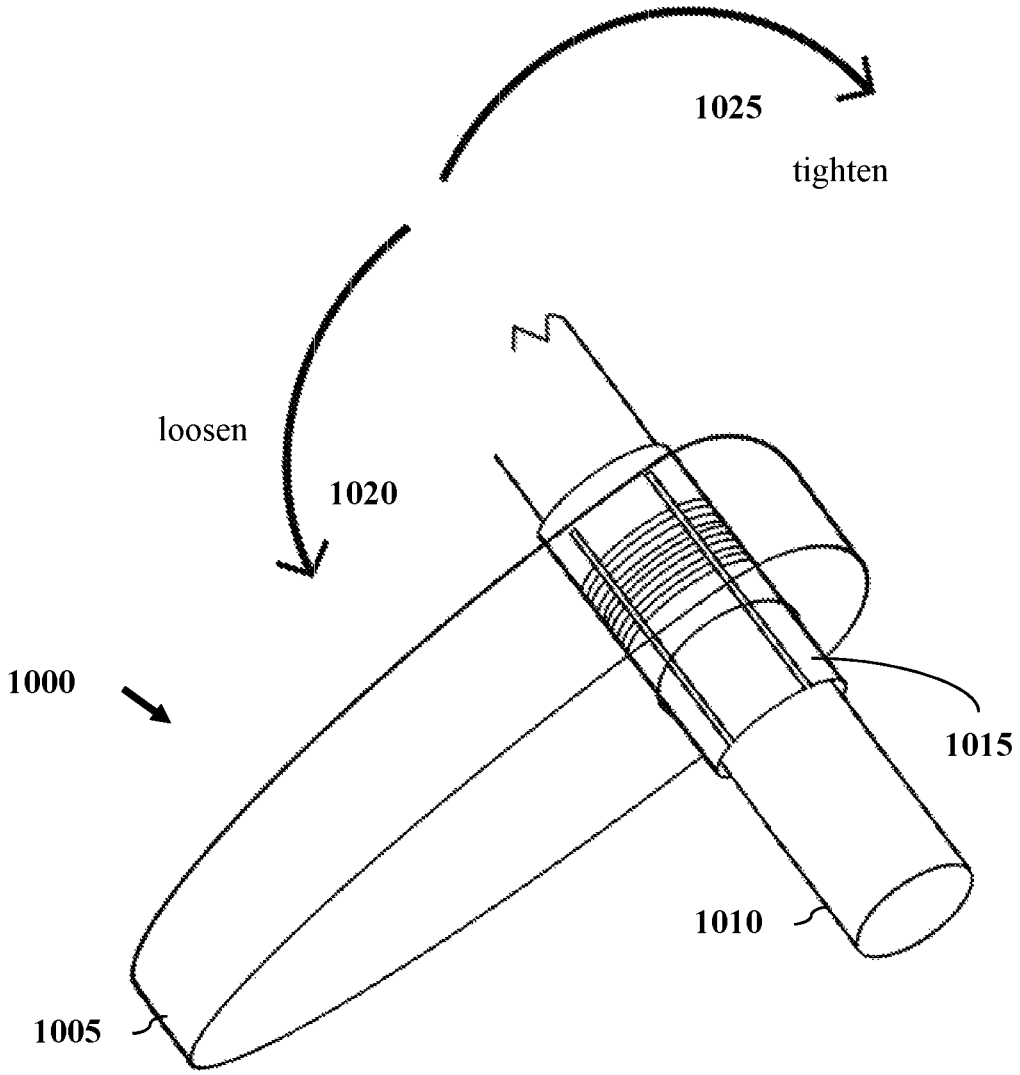
FIGS. 10A-10B depict graphical representations of joint element according to one or more embodiments.
Figure 10B:
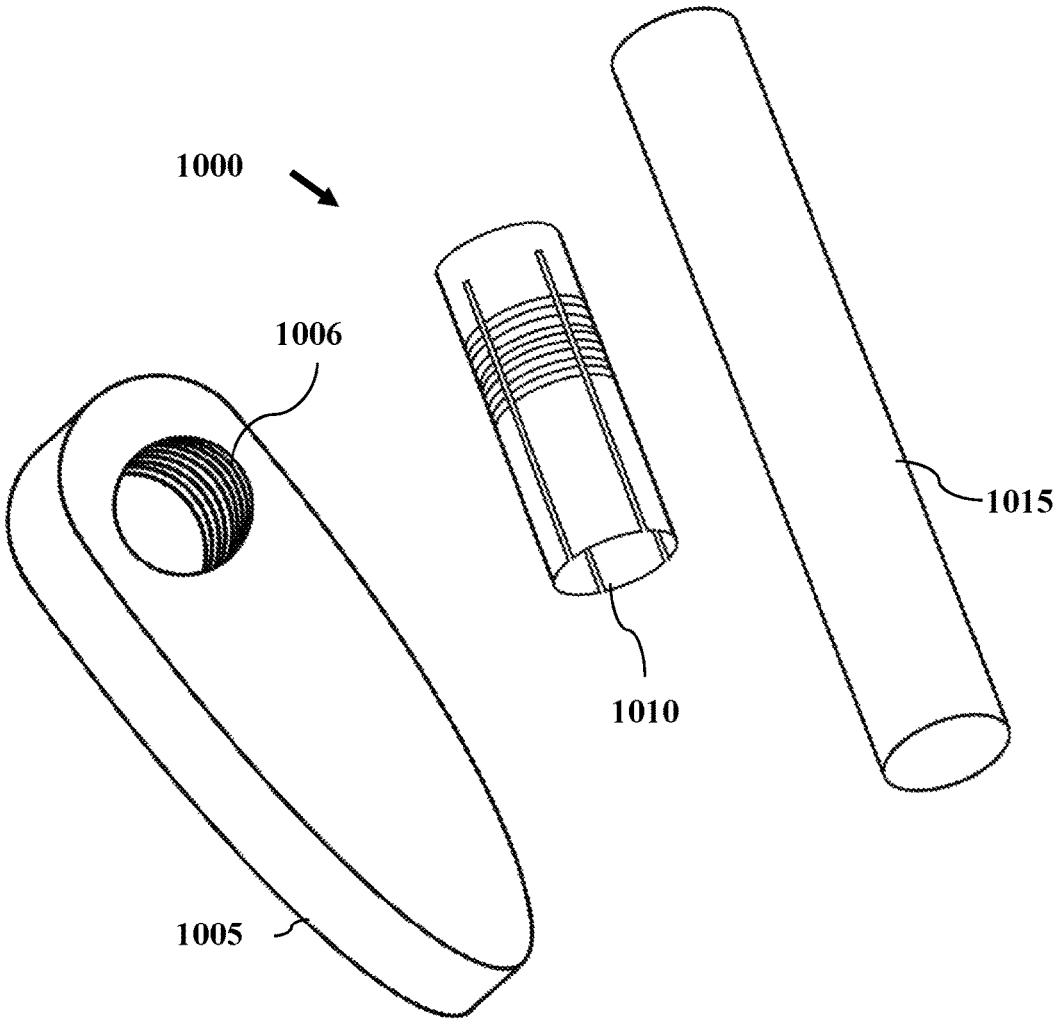

FIGS. 10A-10B depict graphical representations of joint element according to one or more embodiments. According to one embodiment, the joint 1000 includes a threaded cam 1005 that may be mechanically coupled to a shaft 1015 and sheath 1010. According to one embodiment, the threaded cam 1005 may be tightened in one direction, shown by direction 1025 and loosed when rotated in direction 1020. Threaded cam 1005 may be attached to a threaded portion of sheath 1015 wherein rotation compresses sheath 1015 to shaft 1010. In certain embodiments, shaft 1010 may be a hollow piper inserted into the sheath 1015. The Sheath covers a section of the shaft 1015.

FIG. 10B illustrates a dissembled representation of joint 1000 according to one or more embodiments. Cam 1005 includes threaded portion 1006 configured to received sheath 1010 and shaft 1015.

Figure 11:
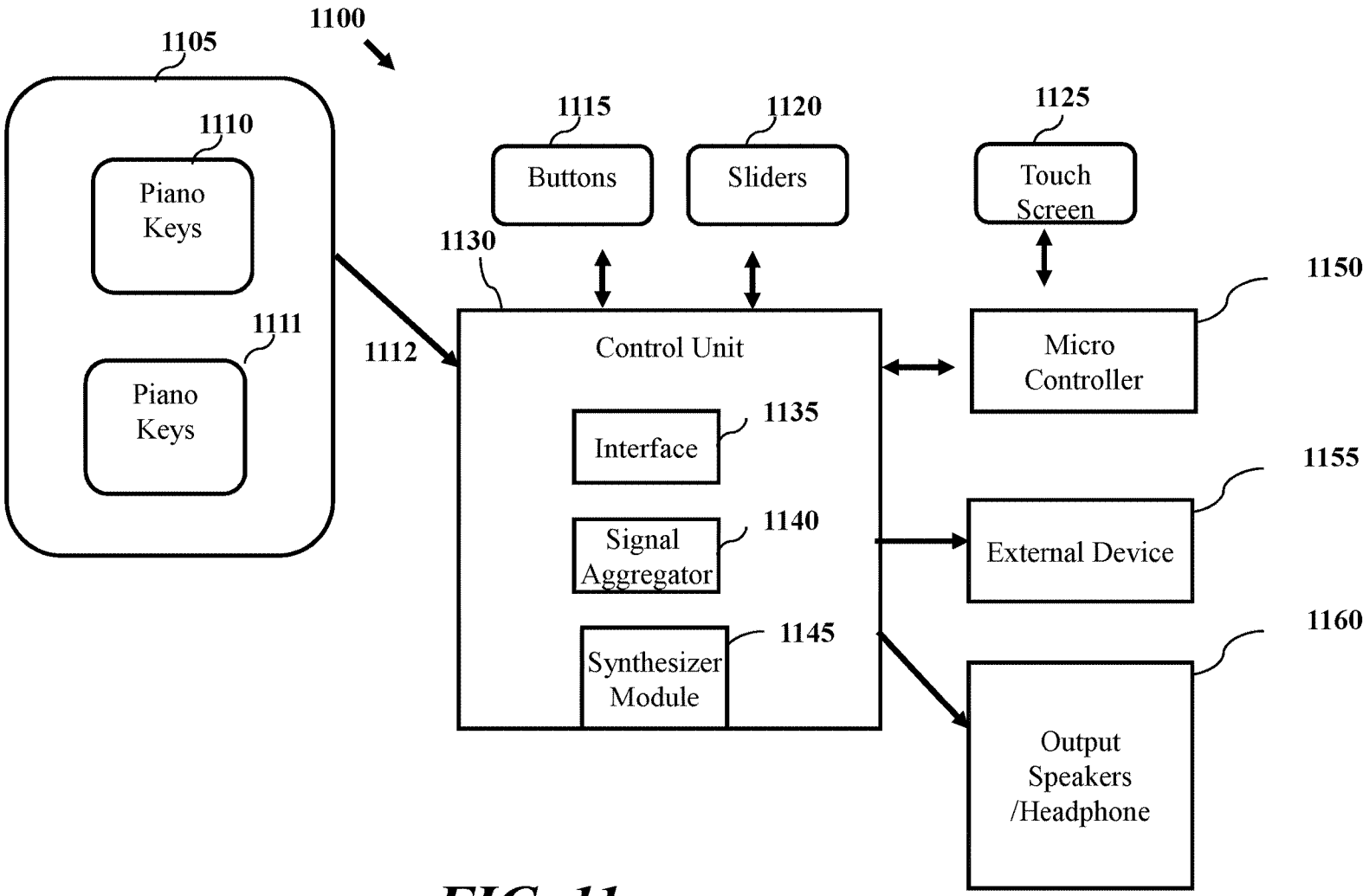
FIG. 11 depicts a graphical representation of device components and operations according to one or more embodiments.

FIG. 11 depicts a graphical representation of device components and operations according to one or more embodiments. According to one embodiment, a double ended keyboard device 1100 may include one or more inputs. Inputs can include keyboard modules, including one or more sets of piano keys (e.g., inputs) such as piano keys 1110 (e.g., first keyboard section) and 1111 (e.g., second keyboard section). Device 1100 may also include one or more buttons 1115 and sliders 1120, which may be located on control surfaces of the device, to control tone of the device. Device 1100 may also provide a touch screen 1125 for one or more functions. Microcontroller 1150 may be a touch screen microcontroller configured to communicate touch screen commands of control unit 1130. Control unit 1130 may be configured to receive input from keyboard module 1105, buttons 1115, sliders 120 and touch screen commands 1125.

According to one embodiment, control unit 1130 may be a processing unit including one or more modules. Modules of control unit 1130 allow for processing input commands to the device and output controls and/or sound to one or more devices. According to another embodiment control unit 1130 may receive input (e.g., key presses) from piano keys 1110 (e.g., first keyboard section) and 1111 (e.g., second keyboard section) by way of link 1112. In one embodiment, link 1112 relates to a cable or connection, and link 1112 may pass through a joint joining a first housing and second housing of the keyboard device. In other embodiments, link 1112 may relate to a wireless communication link (e.g., Bluetooth, short range communication, etc.) between control unit 1130 and piano keys 1110 (e.g., first keyboard section) and 1111.

Operations of keyboard module 1130 may be handled by one or more modules. Interface module 1135 may be a physical interface module configured to detect inputs to piano keys 1110 and 1111 and controls and settings from buttons 1115 and sliders 1120. Physical interface 1135 may also interoperate with microcontroller 1150 for commands from touch screen 1125. Signal aggregator module 1140 may be configured to aggregate all signals from keyboard module 1105 and which may be output to an external device 1155, such as one or more of a computer, digital audio work station, etc. Output by signal aggregator module 1140 may be formatted output according to a control interface. Synthesizer module 1145 may be configured to receive the signal aggregator output and generate one or more sound signals based on settings from one or more of buttons 1115, sliders 1120 and touch screen 1125. Sound output may be provided as output by way of one or more terminals to output speakers/headphones 1160.

Figure 12:
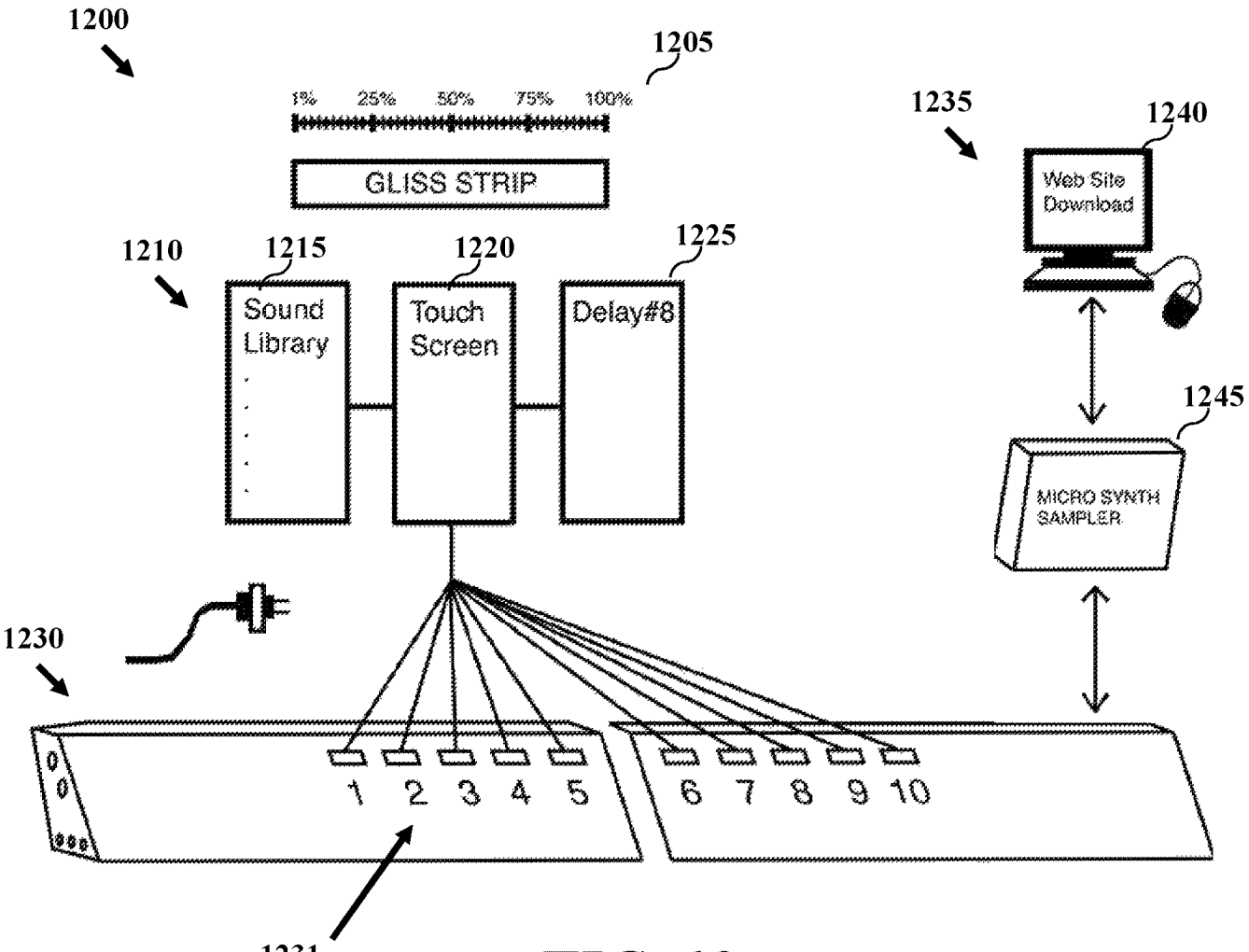
FIG. 12 depicts a graphical representation of control features and operations according to one or more embodiments.

FIG. 12 depicts a graphical representation of control features and operations according to one or more embodiments. According to one embodiment, a key board device is configured to include one or more control features accessible to a user and located on a first housing and second housing of the key board device. Control features 1200 may include one or more types of inputs and control units incorporated with the key board device. According to one embodiment, the keyboard device includes a gliss strip 1205 (e.g., glissando) which may provide a plurality of contact/detection areas that allow for control output and/or sound that relates to a slide (either slow, fast, or varied in tempo) across the input. Gliss strip 1205 may include one or more value indicators (e.g., 1%, 25%, 50%, 75%, 100%, etc.) that may be selected such that contact with the gliss strip and with at least one key of the keyboard device can generate output associated with a glissando effect or slide from one tone to one or more others. The value indicators may be select to control the number of tones include with the gliss strip 1205. In certain embodiments, the gliss strip 1205 may be multi-functional and can be selected for one or more of sound adjustment, control effect levels fast forwarding and rewinding keyboard output, etc.

According to one embodiment, components 1200 of a keyboard device includes one or more interfaces, such as interface 1210, including controls for a sound library 1215, touch screen 1120 and effects control 1225. Sound library 1215 may include one or more sound banks or sound types that may be selected. Touch screen 1220 may include a touch screen display to allow for selection of one or more elements from a graphical user interface. Effects control 1225 may allow for selection of one or more effects, including but not limited to compressions, reverb, delay, distortion, chorus, and pitch change. Components 1200 may be mounted to and or incorporated with the housing 1230 (e.g., first and second housing) of the keyboard device. Touch screen 1220 may also include a vocoder input and auxiliary sound input for the keyboard device. According to one embodiment, output for the double-ended keyboard device is based on one or more sound banks, tone control and pitch settings of the touch screen interface one or more sound banks, tone control and pitch settings of the touch screen interface. For example, wherein at least one instrumental mode may be provided for the double-ended keyboard device for user in at least one configuration including as a synthesizer to an omnichord mode. Toggles may be used to indicate chord settings including but not limited to Major7, minor7, minor7dim and arpeggiation.

Components 1200 may also include a set of definable toggle buttons 1231 that may be set to provide at least one of a desired sound, effect, and saved profile for the keyboard. As such, selection of a toggle button may be detected by the keyboard to define the output characteristics for each of the first and second keyboards. Toggle buttons 1231 may be set using touch screen display 1220. Toggle buttons 1231 may relate to storage of user define effects for the keyboard. Selection of a toggle (e.g., toggle 1) may control the keyboard associated with the housing of the toggle. A second selection of the toggle may turn the effect off. Accordingly, a control unit of the keyboard device may detect toggle selections when generating output, such that the output includes input key presses to a keyboard and considers toggle selections.

According to one embodiment the keyboard device is configured to download one or more sound configurations and effects from a network source such as computer 1240. A keyboard device may execute a process 1235 to receive sound and control settings such as a micro synth sampler 1245 from computer 1240.

FIGS. 13A-13E depict graphical representation of control screen features according to one or more embodiments. Display elements in FIGS. 13A-13C may relate to display configurations and controls for a touch screen display of a keyboard device (e.g., touch screen 1220). Touch screen configuration 1305 relates to a home screen display including display area 1306 identifying one or more of set lists, saved custom sounds, edited sounds, tempos, mid-song changes and combinations. Display area 1307 may be selected to present an edit screen for the touch screen.

Touch screen configuration 1310 relates to an edit screen display including display area 1311 identifying one or more of projects (e.g., past or saved projects) that may be edited. Display area 1312 may be selected to present an interface to toggle one or more selections.

Figure 13A:
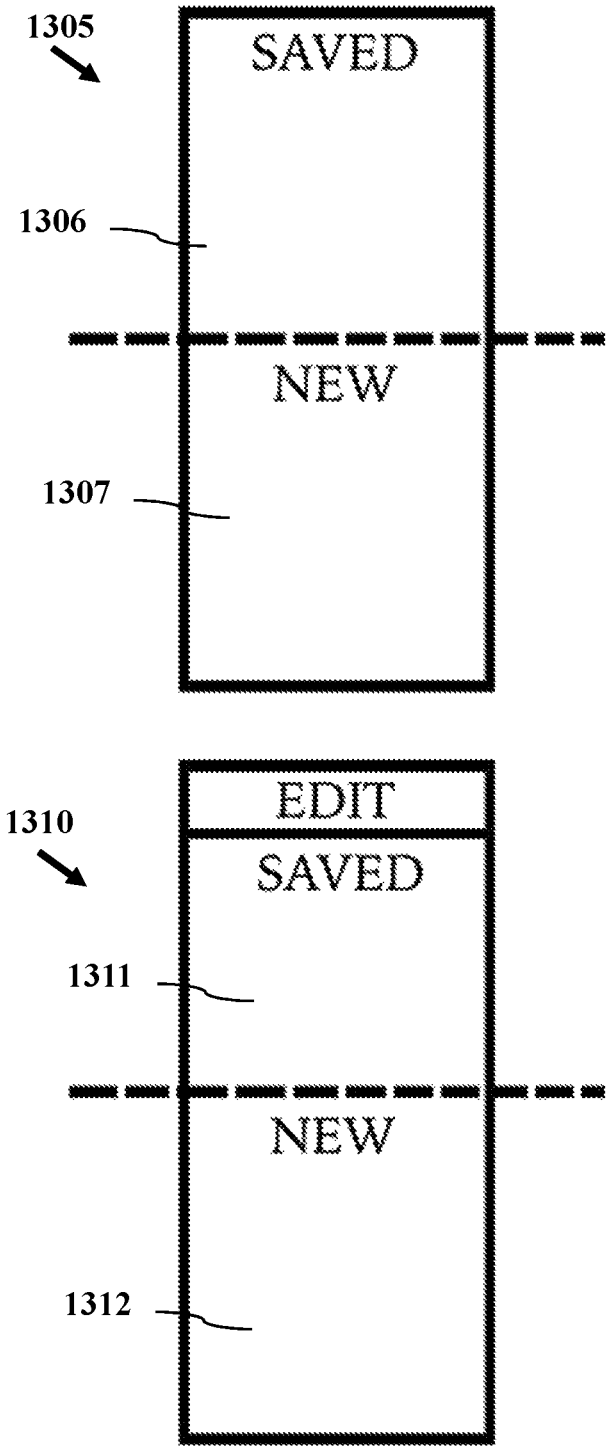
FIGS. 13A-13E depict graphical representation of control screen features according to one or more embodiments.
Figure 13B:
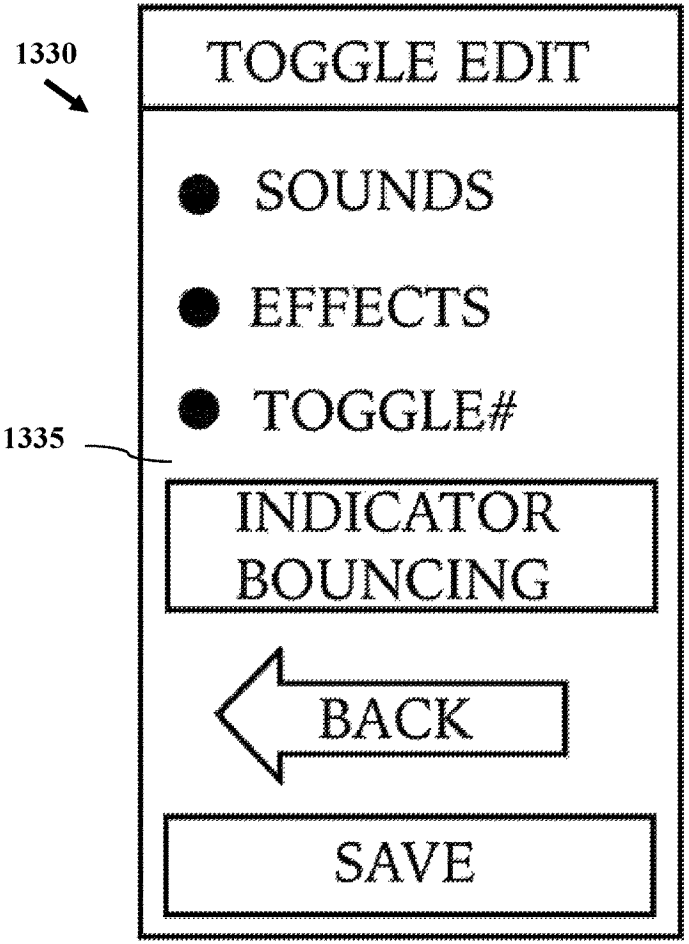

FIG. 13B depicts a graphical representation of user interface configuration that may be displayed on a touch screen (e.g., touch screen 1220). According to one embodiment, a touch screen may present interface 1330 including selectable graphical elements 1335 for at least one of sounds/patches, effects (e.g., delay, reverb, distortion, etc.) scrolling ability to view toggle settings of the keyboard, a back button to return to edit screen display 1310 and a save button.

Figure 13C:
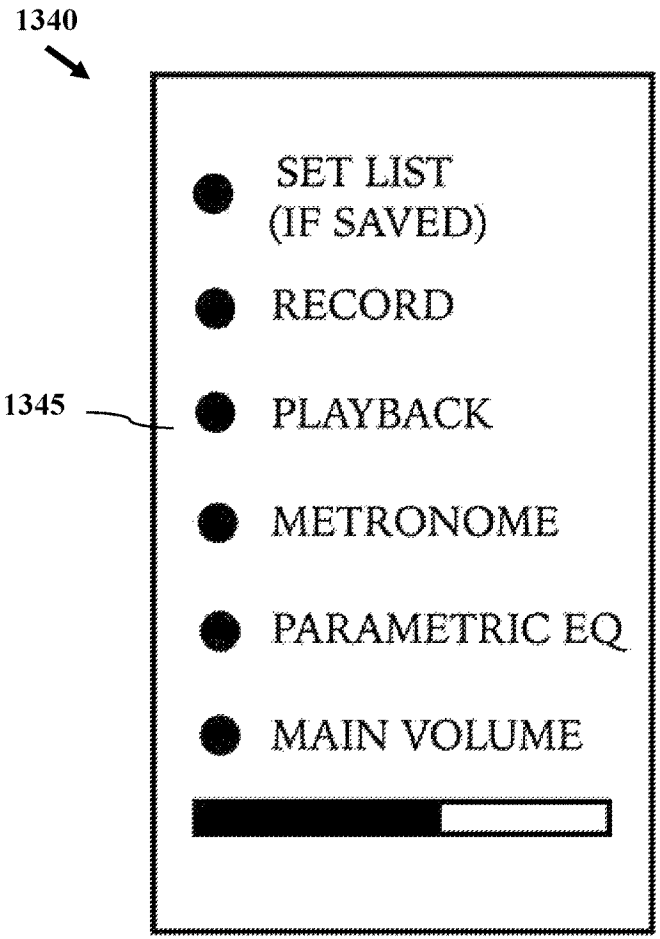

FIG. 13C depicts a graphical representation of user interface configuration that may be displayed on a touch screen (e.g., touch screen 1220). According to one embodiment, a touch screen may present interface 1340 including selectable graphical elements 1345 to set the touch screen mode. Graphical elements 1345 may include elements for selection of a set list mode, record mode, playback mode, metronome mode, parametric mode, and main volume mode. Selection of an element of graphical elements 1345 can allow for display of an element a user can adjust for each mode.

Figure 13E:
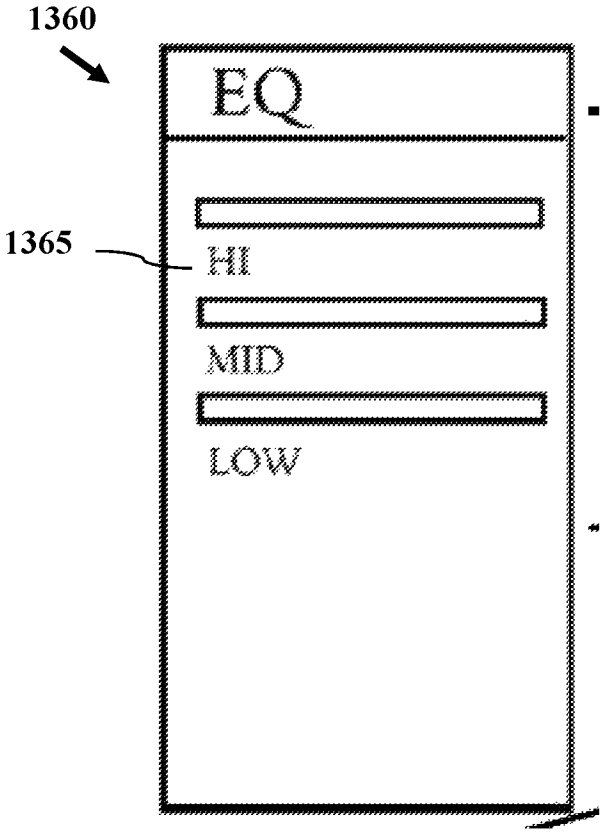
Figure 13D:
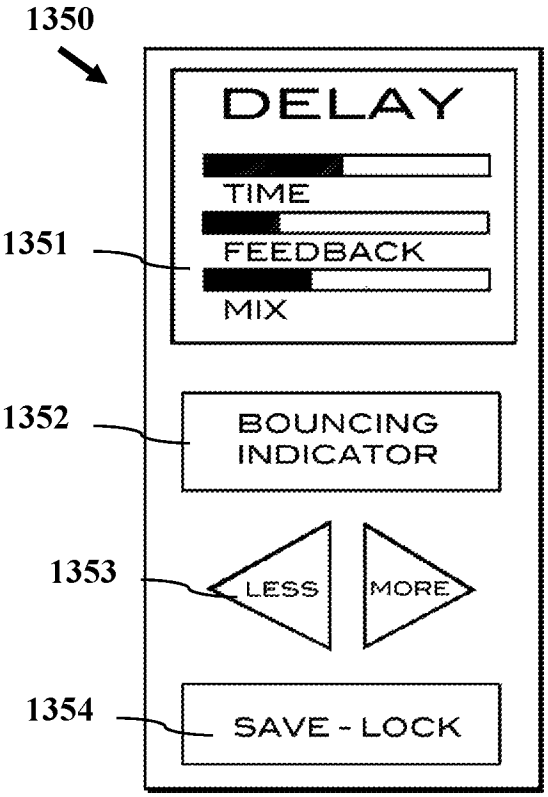

FIG. 13D depicts a graphical representation of user interface configuration that may be displayed on a touch screen (e.g., touch screen 1220) to present interface 1350 including selectable graphical elements to set an effect. FIG. 13D shows a delay effect, however, it should be appreciated that other effects and effect parameters may be included in a touch screen display. Interface 1350 includes selectable elements for effect parameters 1351, such as time (e.g., time delay of the effect, feedback amount and mix parameters). Interface 1350 can also include elements such as a bouncing indicator 1352, direction adjustment arrows 1353 to control the effect level and an element 1354 to save and/or lock settings.

FIG. 13E depicts a graphical representation of user interface configuration that may be displayed on a touch screen (e.g., touch screen 1220) for presenting equalization ("EQ") interface 1360 including selectable graphical elements 1365 to set the output characteristics for low, mid and high frequency components of the keyboard device.

Figure 14:
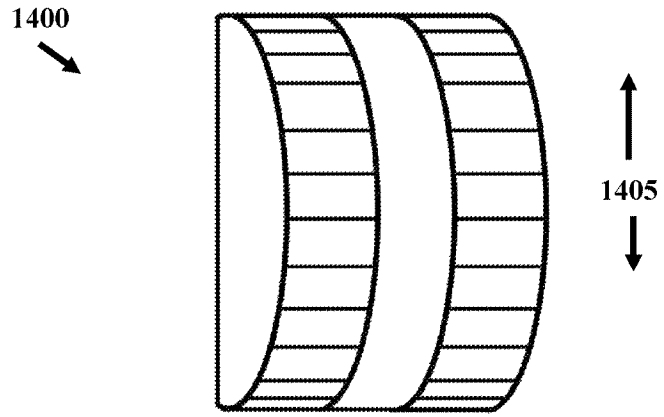
FIG. 14 depicts a graphical representation of a toggle wheel according to one or more embodiments.

FIG. 14 depicts a graphical representation of a toggle wheel according to one or more embodiments. According to one embodiment, a keyboard device can include a toggle wheel for each keyboard section of the keyboard device. Toggle wheel 1400 may provide one or more of a mod wheel function and pitch bend. For example, user selection of a keyboard selection with the toggle wheel 1400 may bend or modify the pitch, tone, and/or output of the keyboard device. According to one embodiment, toggle wheel 1400 may be used to add expression and/or modulate various elements of sound. Toggle wheel 1400 may be manipulated, as shown by direction 1405, to control velocity of sound output to provide a more lifelike sound. Toggle wheel 1400 may provide a pitch bend control which raises or lowers pitch of the notes or sounds generated by the keyboard device.

Figure 15:
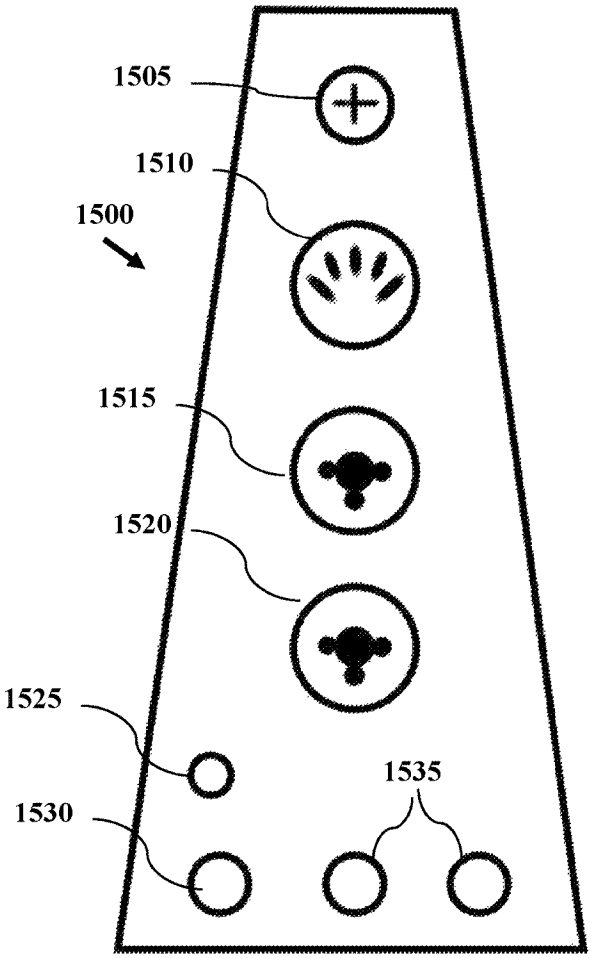
FIG. 15 depicts a graphical representation of a device interface according to one or more embodiments.

FIG. 15 depicts a graphical representation of a device interface according to one or more embodiments. According to one embodiment, a keyboard device includes an output interface for outputting control and/or sound signals. Interface 1500 may be located on a housing of the keyboard device (e.g., first housing, second housing etc.). Interface 1500 is shown including a plurality of terminals and connections, however it should be appreciated that partial inclusion of the terminals may be provided in some embodiments. Interface 1500 includes a strap button 1505 to serve as a mounting point for a strap (e.g., strap pad 300).

Interface 1500 can include control interface terminal 1510 which may output control signals (e.g., MIDI control signals). Terminals 1515 and 1520 may relate to left and right XLR outputs. Terminal 1525 may relate to an auxiliary input configured to receive audio signals which may be received by a control unit of the device and included as output. Terminal 1530 may be a footswitch cable jack. The keyboard device can also include a pair of cable jacks 1535 to provide mono and stereo output.

According to one embodiment, keyboards and device configurations described herein may be configured to allow for variation of key orientation such that one or more keys of a keyboard section may run opposite and/or allow for double sided operation. In one exemplary embodiment, a portion of keys of a keyboard section run opposite to other keys of the same keyboard section to allow for a user's hand to wrap around a body of the keyboard device and allow for a user's thumb to play keys that are oriented in the opposite direction while allow for the user's fingers to operate keys of the keyboard section that do not run in an opposite direction. As such, the user's thumb and fingers can simultaneously active keys of the keyboard section. In certain exemplary embodiments, every "C" key of a keyboard section (e.g., top section, small section, etc.) may run the opposite direction to allow for a user's thumb to activate the "C" keys.

According to one embodiment, the devices and devices components may be formed of one or more materials and material types. In certain embodiments, the devices as described herein and portions thereof, such as the device body, and strap may be formed of materials that are 100% vegan and cruelty free. The devices described herein may be made in America.

While this disclosure has been particularly shown and described with references to exemplary embodiments thereof, it will be understood by those skilled in the art that various changes in form and details may be made therein without departing from the scope of the claimed embodiments.

What is claimed is:

1. A double-ended keyboard device comprising:

a first housing including a first keyboard section and a first housing control surface, wherein keys of the first keyboard section are arranged in a first direction;

a second housing including a second keyboard section and a second housing control surface, wherein keys of the second keyboard are arranged in a second direction, the second direction different from the first direction, wherein the second housing includes a connector socket;

a joint securing the first housing and the second housing, wherein the joint operates to provide rotation of the first housing relative to the second housing along an axis associated with first housing and second housing, wherein the joint includes a shaft received by each of the first housing and second housing, wherein each of the first housing and second housing revolve around the shaft, and wherein the shaft connects to the second housing by the connector socket;

a control unit configured to detect input to each of the first housing and the second housing, the control unit configured to generate output in response to the input; and an output interface coupled to the control unit, the output interface configured to provide output for the double-ended keyboard device in response to input to at least one of the first keyboard section and the second keyboard section.

2. The double-ended keyboard device of claim 1, wherein the first keyboard section and second keyboard section each include a piano keyboard key arrangement having a plurality of keys, wherein each key is associated with a tone.

3. The double-ended keyboard device of claim 1, wherein the first keyboard section and second keyboard section together provide a sequential set of tone inputs for the double-ended keyboard device.

4. The double-ended keyboard device of claim 1, wherein the first keyboard section and second keyboard section each include a plurality of elongated hinge keys, wherein each key is detected as an independent control input.

5. The double-ended keyboard device of claim 1, wherein the first keyboard section is associated with right hand operation, the second keyboard section is associated with left hand operation, and wherein the double-ended keyboard device is configured to be worn by a user.

6. The double-ended keyboard device of claim 1, wherein the first housing control surface and the second housing control surface are arranged along a shared axis.

7. The double-ended keyboard device of claim 1, wherein the joint a cam configured to secure a rotational arrangement of the first housing relative to the second housing.

8. The double-ended keyboard device of claim 1, wherein the joint receives a communication interface from a keyboard section to the controller, wherein the joint is a hollow shaft containing a cable to link a control unit to the first keyboard section and the second keyboard section.

9. The double-ended keyboard device of claim 1, wherein the joint provides rotation and fixed locking position of housing relative to a body line.

10. The double-ended keyboard device of claim 1, wherein the first housing and second housing include planar top surfaces for the control interface.

11. The double-ended keyboard device of claim 1, wherein the control unit is configured to generate sound output for detected input to each of the first keyboard section and second keyboard section.

12. The double-ended keyboard device of claim 1, wherein the control unit is configured to generate control output for detected input to each of the first keyboard section and second keyboard section.

13. The double-ended keyboard device of claim 1, wherein the output interface includes at least one of a single ended input, stereo output, control interface terminal and terminals for at least one external device.

14. The double-ended keyboard device of claim 1, wherein the control unit is configured to generate output for the first keyboard section independent from the second keyboard section and generate output for the second keyboard section independent from the first keyboard section.

15. The double-ended keyboard device of claim 1, further comprising a touch screen interface on the first housing control surface, wherein output for the double-ended keyboard device is based on one or more sound banks, tone control and pitch settings of the touch screen interface, and wherein at least one instrumental mode is provided for the double-ended keyboard device for use in at least one configuration including as a synthesizer to an omnichord mode.

16. A method for operating a double-ended keyboard device comprising:

detecting, by a control unit, input to a first keyboard section;

detecting, by the control unit, input to a second keyboard section;

generating, by the control unit, output based on detected input to the first keyboard section and second keyboard section, wherein a joint secures the first housing and the second housing, wherein the joint operates to provide rotation of the first housing relative to the second housing along an axis associated with first housing and second housing, wherein the joint includes a shaft received by each of the first housing and second housing, wherein each of the first housing and second housing revolve around the shaft, and wherein the shaft connects to the second housing by the connector socket, and wherein the joint is a hollow shaft containing a cable to link the control unit to the first keyboard section and the second keyboard section; and controlling, by the control unit, output for the double-ended keyboard device to an output interface coupled to the control unit in response to detected input to at least one of the first keyboard section and the second keyboard section.

17. The method of claim 16, wherein detecting input to the first keyboard section and second keyboard section includes detecting input piano keyboard key arrangements having a plurality of keys, wherein each key is associated with a tone.

18. The method of claim 16, wherein detecting input to the first keyboard section and second keyboard section includes detecting input to a plurality of elongated hinge keys, wherein each key is detected as an independent control input.

19. The method of claim 16, wherein controlling output for the double-ended keyboard device includes aggregating detected inputs and control settings for providing output to the output interface.

20. A double-ended keyboard device comprising:

a first housing including a first keyboard section and a first housing control surface, wherein keys of the first keyboard section are arranged in a first direction;

a second housing including a second keyboard section and a second housing control surface, wherein keys of the second keyboard are arranged in a second direction, the second direction different from the first direction, wherein the second housing includes a connector socket, wherein the first keyboard section and second keyboard section each include a piano keyboard key arrangement having a plurality of keys, wherein each key is associated with a tone;

a joint securing the first housing and the second housing, wherein the joint operates to provide rotation of the first housing relative to the second housing along an axis associated with first housing and second housing, wherein the joint includes a shaft received by each of the first housing and second housing, wherein each of the first housing and second housing revolve around the shaft, and wherein the shaft connects to the second housing by the connector socket;

a control unit configured to detect input to each of the first housing and the second housing, the control unit configured to generate output in response to the input; and an output interface coupled to the control unit, the output interface configured to provide output for the double-ended keyboard device in response to input to at least one of the first keyboard section and the second keyboard section.

* * * * *